US007198308B2

(12) United States Patent
Lane et al.

(10) Patent No.: US 7,198,308 B2
(45) Date of Patent: Apr. 3, 2007

(54) OPERATING MECHANISM FOR A MOVABLE CLOSURE ELEMENT

(75) Inventors: Christopher M. Lane, New Hampton, IA (US); Ricci L. Marzolf, New Hampton, IA (US)

(73) Assignee: Tri/Mark Corporation, New Hampton, IA (US)

( * ) Notice: Subject to any disclaimer, the term of this patent is extended or adjusted under 35 U.S.C. 154(b) by 165 days.

(21) Appl. No.: 10/811,693

(22) Filed: Mar. 29, 2004

(65) Prior Publication Data

US 2005/0212307 A1 Sep. 29, 2005

(51) Int. Cl.
*E05B 3/00* (2006.01)

(52) U.S. Cl. ..... 292/336.3; 292/DIG. 64

(58) Field of Classification Search ..... 292/336.3, 292/123, 97, 48, 26, 221, 223, DIG. 64
See application file for complete search history.

(56) References Cited

U.S. PATENT DOCUMENTS 5,806,900 A * 9/1998 Bratcher et al. ..... 292/137
5,845,947 A * 12/1998 Arabia et al. ..... 292/1
5,934,817 A 8/1999 Kim et al.
5,947,534 A * 9/1999 Zarzycki, Jr. ..... 292/92
6,183,024 B1 * 2/2001 Schultz et al. ..... 292/175
6,340,183 B1 * 1/2002 Ramsauer ..... 292/175
6,419,284 B1 * 7/2002 Kutschat ..... 292/56
6,578,446 B2 * 6/2003 Staser et al. ..... 74/519
2002/0195826 A1 * 12/2002 Fountaine ..... 292/96
2004/0113440 A1 6/2004 Zweibohmer et al.
2004/0222647 A1 * 11/2004 Smith et al. ..... 292/336.3

FOREIGN PATENT DOCUMENTS

EP 1096086 5/2001

* cited by examiner

*Primary Examiner*—Gary Estremsky
(74) *Attorney, Agent, or Firm*—Wood, Phillips, Katz, Clark & Mortimer

(57) ABSTRACT

An operating mechanism to releasably engage a strike assembly to maintain a movable closure element in a predetermined position. The operating mechanism has a base with a first axis and a wall extending around the first axis and defining a passageway. A latch system has (a) a latched state in which the latch system engages a strike element and (b) a released state wherein the latch system can be disengaged from the strike element. The operating mechanism further includes an actuating system that is changeable from a first state into a second state to thereby change the state of the latch system. The actuating system has a first link which is movable within the passageway from a first position into a second position to change the state of the latch system. The actuating system further includes an actuating assembly that can be connected to the base without requiring separate fasteners.

58 Claims, 14 Drawing Sheets

OPERATING MECHANISM FOR A MOVABLE CLOSURE ELEMENT

BACKGROUND OF THE INVENTION

1. Field of the Invention

This invention relates to movable elements, such as closure elements, and, more particularly, to an operating mechanism through which a) the closure element can be repositioned and b) a latch system can be operated.

2. Background Art

Movable elements, such as closure elements, are used in a wide range of environments, for both static and dynamic applications. Typically, closure elements are mounted to be moved between open and closed positions. The closure elements are typically either translated or pivoted between the open and closed positions therefor.

In one exemplary environment, closure elements are pivotably mounted on cabs of earth moving and agricultural equipment. One common operating mechanism for such closure elements includes an elongate, tubular element into which an operating assembly for a latch system is integrated. An exemplary system of this type is shown in pending U.S. application Ser. No. 10/316,359, commonly owned with the invention herein. The tubular element is spaced from a mounting surface on a side of the closure element to allow it to be surrounded and grasped by a user's hand to allow manipulation of the closure element. The operating mechanism includes an operating assembly with a pivotable actuator that can be selectively repositioned to operate a latch system through the same hand that is grasping the tubular element. This configuration of the operating mechanism permits a positive controlling of the closure movement while allowing the state of the latch system to be conveniently controlled with the same hand that is used to reposition the closure element.

While this configuration of operating mechanism has become well accepted in the industry, it has at least one significant limitation from the standpoint of its manufacture. The integration of the operating components into the tubular element, and the interconnection of the same to the latch system, may be somewhat difficult and time consuming, when this is carried out either on site or at a manufacturing facility. This problem is attributable in large part to the fact that the diameter of the tubular element, to be conveniently graspable, provides a relatively small internal space within which the operating components can be assembled.

One common construction for this type of operating mechanism utilizes an elongate rod which is shiftable axially relative to the tubular element to control the state of the latch system. The components of the operating assembly through which this rod is axially shifted are installed radially through the wall of the tubular element at a location spaced from the latch system. An exemplary system of this type is shown in U.S. Pat. No. 6,419,284. As can be seen therein, the working space available to the manufacturer/installer is relatively small. Additionally, the components of the operating assembly, installed radially through the opening, are commonly maintained in place by one or more separate fasteners that must be installed. These fasteners are generally quite small. A significant amount of skill and dexterity may thus be required for the installer to assemble the operating mechanism. This may account for a relatively lengthy assembly time, which translates into added costs to be borne either by the manufacturer or consumer.

Also, this conventional construction does not lend itself to on-site assembly and installation. One desirable feature with this type of operating mechanism is the ability to allow the purveyor to selectively use elongate, tubular elements of different configurations to best adapt to a field condition. With the above-described construction, the operating mechanism and latch system are commonly made and offered only in a fixed configuration. From the standpoint of those that supply these systems, inconvenience is contended with by reason of the fact that inventories must be prepared based upon anticipated demand for each different configuration. Additionally, if a custom application is required, the cost thereof to the consumer may be impractically high.

SUMMARY OF THE INVENTION

In one form, the invention is directed to an operating mechanism for a movable closure element to releasably engage a strike assembly on a frame support and thereby releasably maintain the movable closure element in a predetermined position relative to the frame support. The operating mechanism has a base with an elongate portion with a first axis and a wall extending around the first axis and defining a passageway. A latch system on the base has (a) a latched state in which the latch system engages a strike element on the strike assembly so as to maintain a movable closure element on which the operating mechanism is mounted in the predetermined position and (b) a released state wherein the latch system can be disengaged from the strike element so as to allow a movable closure element on which the operating mechanism is mounted to be moved from the predetermined position. The operating mechanism further includes an actuating system on the base that is changeable from a first state into a second state to thereby change the latch system from the latched state into the released state. The actuating system has at least a first link which is movable axially within the passageway from a first position into a second position to thereby change the latch system from the latched state into the released state. The actuating system further includes an actuating assembly that can be directed radially through the wall on the base into operative engagement with the base without requiring separate fasteners to maintain the operative engagement between the actuating assembly and the base.

In one form, the actuating system has a second link that can be operatively engaged with the at least first link without requiring separate fasteners.

In one form, the second link has a receptacle for supporting a part of the at least first link for pivoting movement about a second axis that is transverse to the first axis.

In one form, the second link has a slot communicating with the receptacle and extending radially relative to the second axis from the receptacle.

The actuating assembly may include an actuating element that is repositionable relative to the base between a normal position and an actuated position. The second link may connected to the actuating element.

In one form, the second link is connected to the actuating element for relative pivoting movement around a third axis.

The third axis may be substantially parallel to the second axis.

In one form, the actuating element is movable relative to the base around a fourth axis.

In one form, the slot extends radially along a line relative to the second axis from the second axis. The second link is movable around the fourth axis between first and second orientations. The second link is in the first orientation with the actuating element in the normal position and in the second orientation with the actuating element in the actuated position. With the second link in and between the first and second orientations, a line of a force acting between the second link and the part of the at least first link is non-parallel to the line of the slot.

In one form, the second link has an end that slides axially relative to the first axis guidingly along the wall as the actuating element is repositioned between the normal and actuated positions.

In one form, the wall has a first opening bounded by an edge with a thickness. The actuating system further has a frame with first and second oppositely facing surfaces. The actuating element is mounted for pivoting movement relative to the frame around the fourth axis. At least a part of the frame is deformable so that as the frame is pressed into the wall opening, the at least part of the frame changes from an undeformed state into a deformed state to allow the first surface on the frame to move past the edge and thereafter reassume the undeformed state so that the edge of the wall is captive between the first and second surfaces, whereupon the actuating assembly is in operative engagement with the base.

In one form, the first and second surfaces are spaced by a distance that is approximately the same as the thickness of the edge.

In one form, the second surface extends substantially fully around the wall opening and bears against a surface on the base that faces radially outwardly relative to the first axis.

In one form, the part of the at least first link has a diameter, with the slot having a width. The slot width is less than the diameter of the part of the at least first link.

In one form, the wall has an annular, outwardly facing surface and there is no opening in the outwardly facing surface diametrically opposite to the first opening.

In one form, the actuating system has a frame to which the actuating element is mounted for pivoting movement around the fourth axis and the housing is reversibly mountable in first and second different positions relative to the base so that the actuating element pivots in opposite directions around the fourth axis as the actuating element is repositioned from the normal position into the actuated position with the housing in the first and second different positions.

In one form, the base has a first tubular element with an outside surface having a first diameter through which the first opening is formed. The operating mechanism may be further provided in combination with a second tubular element having an outside surface through which a second opening corresponding to the first opening is formed. The second tubular element has a second diameter that is different than the first diameter. The frame can be selectively pressed into the first and second openings to place the actuating assembly into operative engagement with the base.

In one form, the second link has a first configuration. An interchangeable link may be provided having a configuration that is different than that of the second link and useable in place of the second link with the actuating assembly in operative engagement with the base, using the second tubular element.

In one form, the actuating system further has a spring acting between the actuating element and the second link for normally urging the second link towards the second orientation.

In one form, the base has a tubular element that defines the elongate portion and first and second supports for the tubular element that are spaced axially relative to the first axis.

The tubular element may be releasably connectable to each of the first and second supports to allow selective connection of tubular elements of different configuration to the first and second supports.

In one form, the tubular element can be selectively connected to the first support in first and second different, predetermined, angular orientations.

The tubular element may be releasably connectable with the first support without requiring any separate fasteners. With the tubular element connected to the first support and the first and second supports mounted to a closure element, the tubular element and first support cannot be separated from each other.

In one form, the second link exerts a tensile force on the at least first link as the at least first link is moved from the first position into the second position.

Alternatively, the second link may exert a compressive force on the at least first link as the at least first link is moved from the first position into the second position.

In one form, the at least first link has an elongate portion with a free end and the part of the at least first link is spaced from the free end.

In one form, the elongate portion has a substantially straight section extending along a first line substantially parallel to the first axis and the part of the at least first link extends transversely to the first line along a second line.

In one form, the at least first link has a free end section which projects a) along a third line that is transverse to the second line and b) to the free end of the elongate portion.

The first and third lines may be substantially parallel to each other.

In one form, the elongate portion of the at least first link is connected to the second link by directing the elongate portion of the at least first link through the receptacle by relatively reorienting the at least first link and second link, while relatively moving the elongate portion of the at least first link and second link along the first and second lines, as the elongate portion of the at least first link is directed through the receptacle.

The operating mechanism may be provided in combination with a movable closure element to which the operating mechanism is attached.

The operating mechanism and movable element may further be provided in combination with a frame support having a strike assembly. The movable element is mounted for movement between the predetermined position and a second position, with the latch system engaging the strike assembly with the movable element in the predetermined position.

In one form, the wall has an opening bounded by an edge and the frame has a wall and a transverse flange that cover the edge so that the edge is not exposed to a user of the operating mechanism.

The invention is further directed to an operating mechanism for a movable closure element to releasably engage a strike assembly on a frame support and thereby releasably maintain the movable closure element on which the operating mechanism is mounted in a predetermined position relative to the frame support. The operating mechanism has a base with an elongate portion with a first axis and a wall extending around the first axis and defining a passageway. The operating mechanism further includes a latch system on the base and having (a) a latched state in which the latch system engages a strike element on the strike assembly so as to maintain a movable closure element on which the operating mechanism is mounted in the predetermined position and (b) a released state wherein the latch system can be disengaged from a strike element so as to allow a movable closure element on which the operating mechanism is mounted to be moved from the predetermined position. The operating mechanism further includes an actuating system on the base that is changeable from a first state into a second state to thereby change the latch system from the latched state into the released state. The actuating system has at least a first link which is movable axially within the passage from a first position into a second position to thereby change the latch system from the latched state into the released state. The actuating system further has an actuating assembly for the at least first link and a second link that can be operatively connected to the at least first link without requiring separate fasteners.

The second link may have a receptacle for supporting a part of the at least first link for pivoting movement about a second axis that is transverse to the first axis.

In one form, the second link has a slot communicating with the receptacle and extending radially relative to the second axis from the receptacle.

The actuating assembly may have an actuating element that is repositionable relative to the base between a normal position and an actuated position. The second link is connected to the actuating element.

The second link may be connected to the actuating element for relative pivoting movement around a third axis.

In one form, the third axis is substantially parallel to the second axis.

The actuating element may be movable relative to the base around a fourth axis.

In one form, the second link has an end that slides axially relative to the first axis guidingly along the wall as the actuating element is repositioned between the normal and actuated positions.

In one form, the second link is selectively reversibly mountable for movement in opposite directions around the fourth axis as the actuating element is changed from the normal position into the release position.

The actuating system may further include a spring acting between the actuating element and the second link for normally urging the second link in movement around the third axis.

In one form, the second link exerts a tensile force on the at least first link as the at least first link is moved from the first position into the second position.

The second link may exert a compressive force on the at least first link as the at least first link is moved from the first position into the second position.

In one form, the at least first link has an elongate portion with a free end and the part of the at least first link is spaced from the free end.

The elongate portion may have a substantially straight section extending along a first line substantially parallel to the first axis. The part of the at least first link extends transversely to the first line along a second line.

The at least first link may have a free end section which projects a) along a third line that is transverse to the second line and b) to the free end of the elongate portion.

In one form, the first and third lines are substantially parallel to each other.

The elongate portion of the at least first link may be connected to the second link by directing the elongate portion of the at least first link through the receptacle by relatively reorienting the at least first link and second link while relatively moving the elongate portion of the at least first link and second link along the first and second lines as the elongate portion of the at least first link is directed through the receptacle.

The operating mechanism may be provided in combination with a movable closure element to which the operating mechanism is attached.

The movable closure element and operating mechanism may be further provided in combination with a frame support having a strike assembly. The movable element is mounted for movement between the predetermined position and a second position. The latch system engages the strike assembly with the movable element in the predetermined position.

DETAILED DESCRIPTION OF THE DRAWINGS

Figure 1:
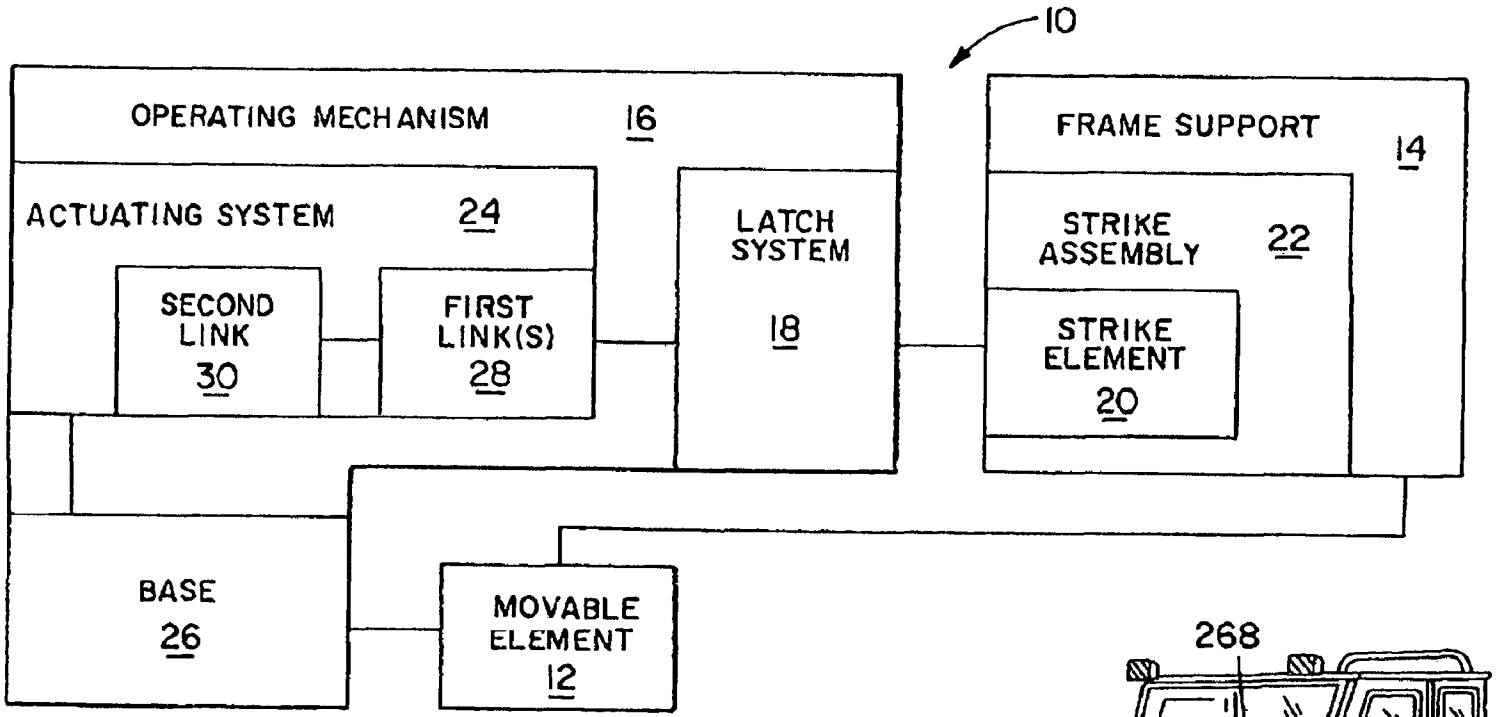
FIG. 1 is a schematic representation of a system, according to the invention, including a movable element mounted upon a frame support and having an operating mechanism thereon which releasably, maintains the movable element in a predetermined position relative to the frame support through engagement between a latch system on the movable element and a strike assembly on the frame support.

A schematic representation of a system, incorporating the present invention, is shown at 10 in FIG. 1. The system 10 includes a movable element 12 that may be virtually any type of element, such as a closure element, in either a static or dynamic environment, that is movable between first and second different positions relative to a frame support 14, and releasably maintainable in a predetermined position relative to the frame support 14. The movable element 12 may be repositionable by movement pivotably, translationally, etc., relative to the frame support 14 between the first and second positions. An operating mechanism 16 is mounted on the movable element 12. The operating mechanism 16 has an associated latch system 18 having (a) a latched state, wherein the latched system 18 engages a strike element 20 on a strike assembly 22 on the frame support 14 so as to maintain the movable element 12 in a predetermined position and (b) a released state wherein the latch system 18 can be disengaged from the strike element 20 so as to allow the movable element 12 to be moved from the predetermined position. The latch system 18 is changed from the latched state into the released state through an actuating system 24 mounted upon a base 26 on the movable element 12. The actuating system 24 includes at least a first link 28, in the form of an elongate rod with a substantially rigid, fixed shape, which operatively connects to the latch system 18, and a second link 30 which changes the at least first link 28 from a first position into a second position to thereby change the latch system 18 from the latched state into the released state. With the actuating system 24 in a first state, the second link is in a first orientation, the at least first link 28 is in the first position, and the latch system 18 is in the latched state. With the actuating system 24 in a second state, the second link 30 is in a second orientation, the at least first link 28 is in the second position, and the latch system 18 is in the released state.

The system 10 is shown in generic form because it is contemplated that the environment for the present invention and the configuration thereof may take myriad different forms. One exemplary environment for, and form of, the present invention, will now be described. It should be understood that the following description is intended to be exemplary in nature only and not limited to the specific structure shown and described.

Figure 2:
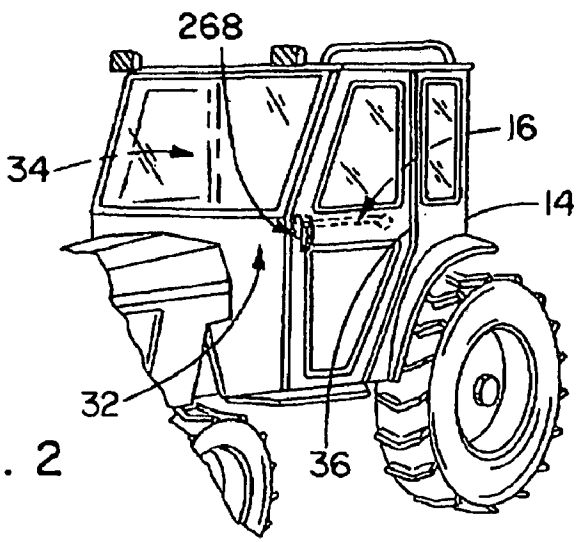
FIG. 2 is a fragmentary, perspective view of a frame support in the form of an agricultural implement having a movable element in the form of a closure, with the inventive operating mechanism thereon and the closure in a closed position.
Figure 3:
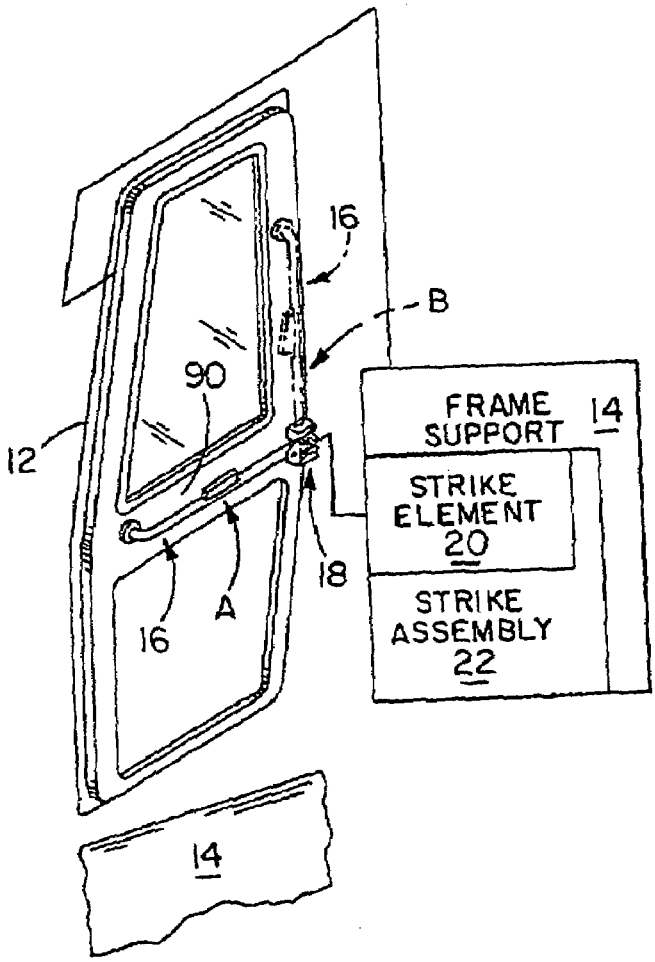
FIG. 3 is an enlarged, fragmentary, partially schematic representation of the agricultural implement in FIG. 2 with the closure in an open position and a graspable tubular element on the operating mechanism in two alternative orientations.

In FIGS. 2 and 3, the frame support 14 is shown as a wheeled agricultural implement having a cab at 32 with an internal compartment 34 that can be occupied by a user. The cab 32 has an access opening 36 which can be selectively closed and exposed by a movable element 12 in the form of a closure. The closure 12 is movable relative to the frame support 14 selectively between a closed position, as shown in FIG. 2, and an open position, as shown in FIG. 3. The closure 12 is releasably maintainable in the closed position through cooperation between the operating mechanism 16 and strike assembly 22, as hereinafter described.

Figure 5:
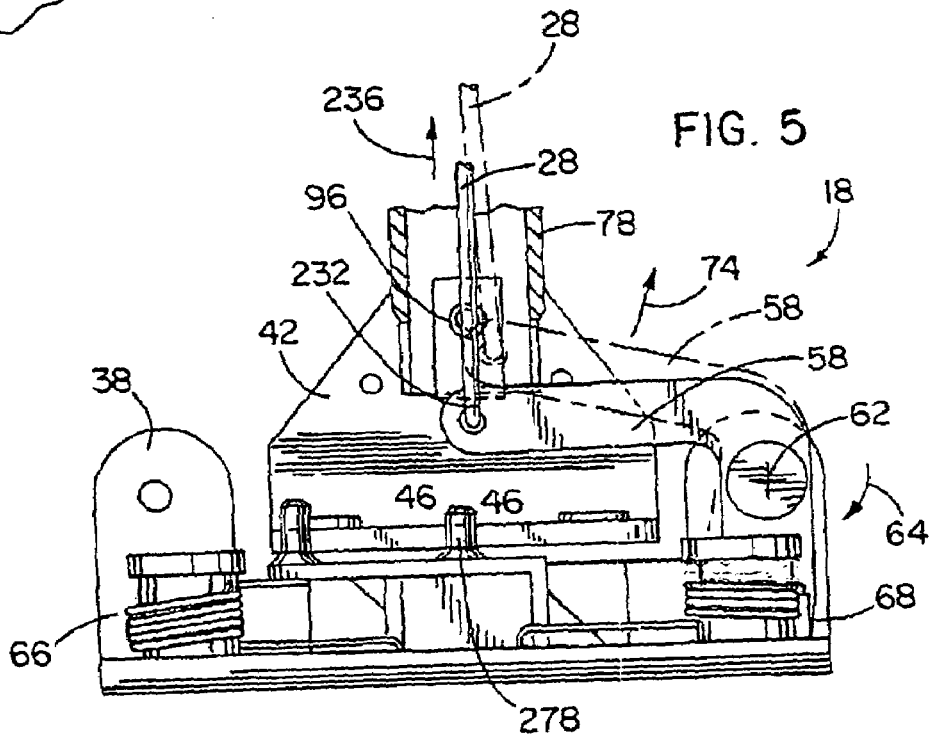
FIG. 5 is an enlarged, fragmentary, elevation view of the latch system in FIG. 4 with an operator thereon shown in two different states.
Figure 4:
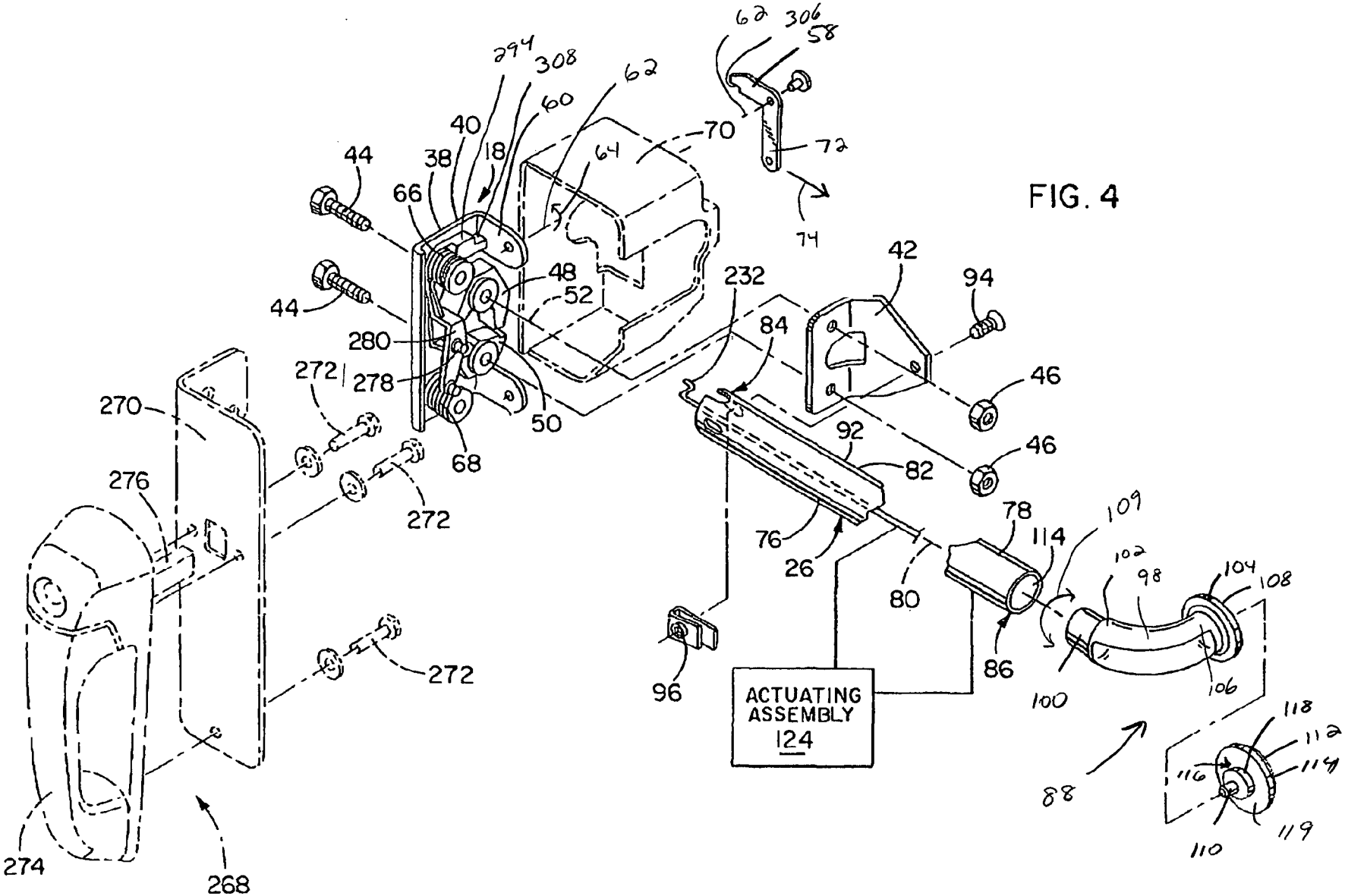
FIG. 4 is an enlarged, exploded, perspective view of the inventive operating mechanism in FIGS. 2 and 3 and showing an optional, separate, redundant actuator for the latch system on the operating mechanism.
Figure 6:
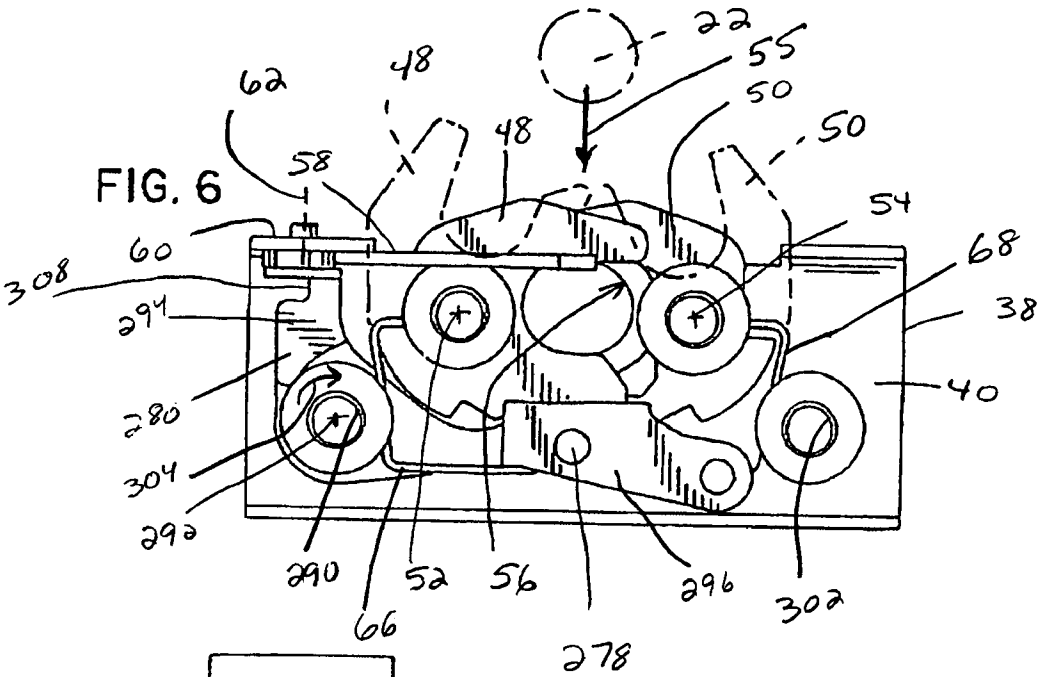
FIG. 6 is an enlarged, end, elevation view of the latch system in FIGS. 4 and 5 and showing rotors thereon in latched positions in solid lines and in released positions in phantom lines and in relationship to a strike element.
Figure 7:
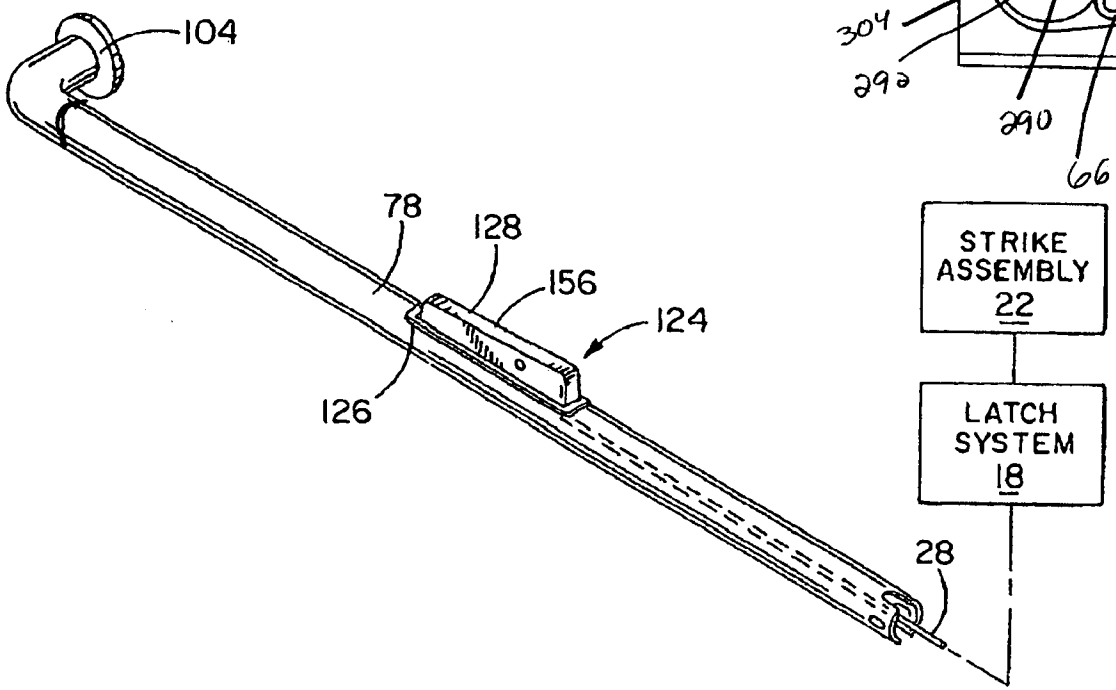
FIG. 7 is an enlarged, partially schematic, perspective view of the inventive operating mechanism in association with a strike assembly.
Figure 8:
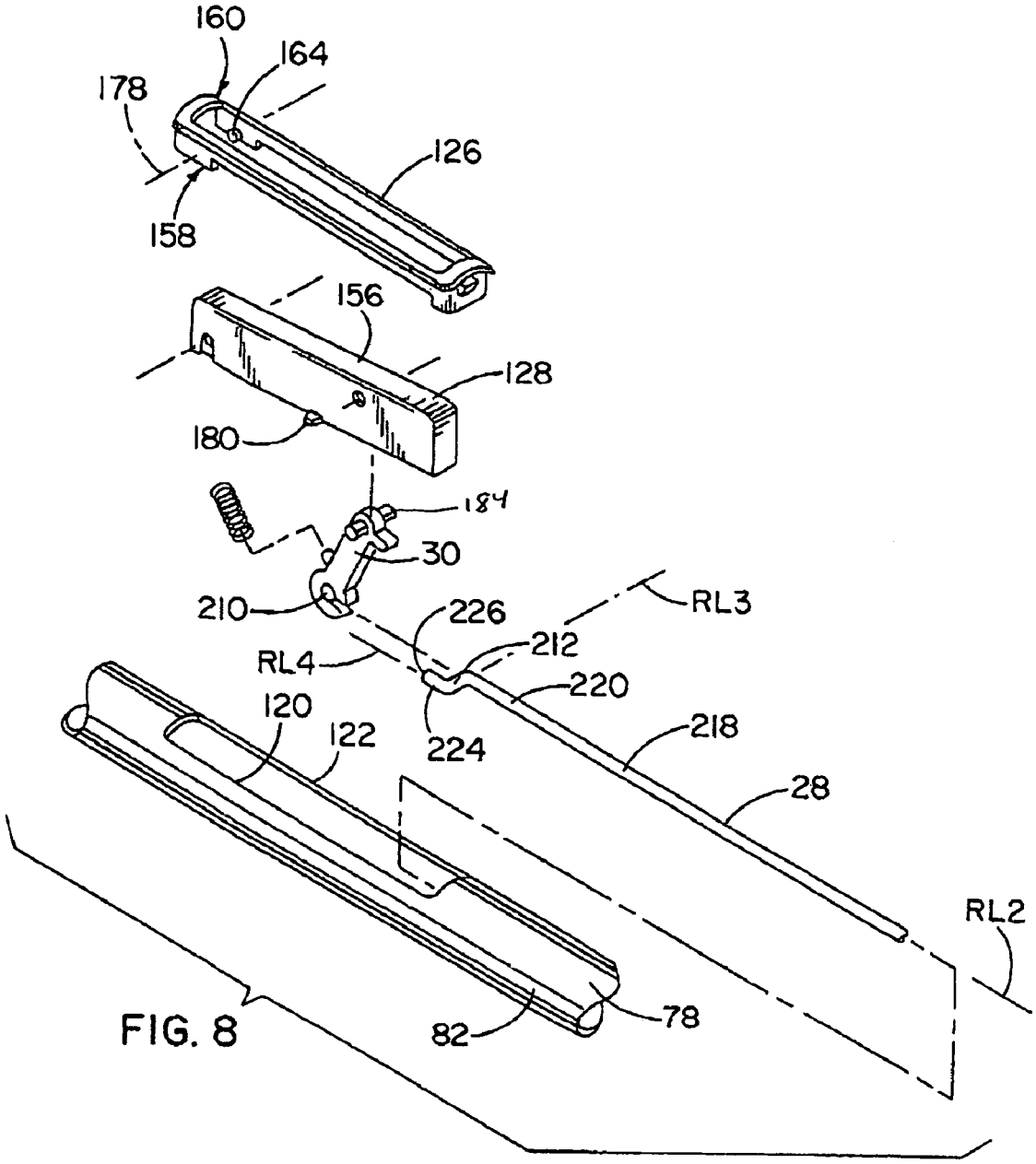
FIG. 8 is an enlarged, exploded, fragmentary, perspective view of the actuating system on the inventive operating mechanism and including an actuating assembly with a frame, an actuating element that is pivotably mounted to the frame, and a link, which link is pivotably mounted to the actuating element for driving a separate link to operate the latch system.

As seen in FIGS. 4–6, the latch system 18 on the operating mechanism 16 includes a housing 38, consisting of joinable first and second parts 40,42 which are maintained together through bolts 44 and nuts 46. The housing 38 supports cooperating rotors 48,50, which are pivotable about parallel axes 52,54 between latched positions, as shown in solid lines in FIG. 6, and released positions, as shown in dotted lines in FIG. 6. The specific details of the operation of the latch system 18 are not critical to the present invention. It is sufficient to say that the rotors 48,50 are normally spring biased to their released positions. As the closure 12 is moved from the open position into the closed position, the strike element 20 on the strike assembly 22 is caused to bear upon the rotors 48,50 in the direction of arrow 55 in FIG. 6. As the closure 12 moves further towards the closed position, the rotors 48,50 are pivoted about their axes 52,54 from the released positions into the latched positions. In the latched positions for the rotors 48,50, the rotors 48,50 cooperatively define a closed receptacle 56 for the strike element 20, which is captively maintained therewithin. With the rotors 48,50 in their latched positions, the latch system 18 is in the latched state.

An L-shaped operator 58 is mounted to a tab 60 on the housing 38 for pivoting movement around an axis 62. With the latch system 18 in the latched state, pivoting movement of the operator 58 in the direction of the arrow 64 in FIG. 4, around the axis 62, releases the rotors 48,50 so that they are driven under a stored bias force, produced by coil springs 66,68, into their released positions. With the rotors 48,50 in their released positions, the latch system 18 is in the released state. An optional cover 70 may be provided to shield the user from the mechanism on the housing 38 and for purposes of aesthetics.

As previously noted, the operating mechanism 16 is contemplated to be used with myriad different types of latch systems including, for example, those utilizing a single rotor. The latch system 18 is intended only as one representative structure. The inventive concept, as explained in greater detail below, can be used in association with any latch system that is operable by repositioning an element through the application of either a compressive or tensile force. In the initial embodiment described herein, the latch system 18 is changeable from the latched state into the released state by exerting a force on an arm 72 of the operator 58 generally in the direction of arrow 74 in FIG. 4 that causes the operator 58 to pivot in the direction of the arrow 64 around the axis 62.

The base 26 on the operating mechanism 16 consists of an elongate portion 76 defined by a hollow tubular element 78 having a central axis 80 around which a wall 82 extends. The tubular element 78 has spaced axial ends 84,86. The end 84 is mounted to the closure 12 through a support element, in this embodiment defined by the housing part 42. A separate support at 88 mounts the opposite end 86 of the tubular element 78 to the closure 12 so that the tubular element 78 is spaced from an inside surface 90 (FIG. 3) of the closure 12 to allow the radially outwardly facing surface 92 on the tubular element 78 to be grasped by the hand of a user to facilitate repositioning of the closure 12.

In this embodiment, a bolt 94 extends through the support/housing part 42 and the tubular element 78 and is secured by a U-shaped spring nut 96 clipped to the end of the tubular element 78. The housing 38, including the support/housing part 42, is suitably secured to the closure 12, as shown for example in previously referenced U.S. patent application Ser. No. 10/316,359.

The support 88 consists of an elbow 98 with a reduced diameter male portion 100 on one leg 102 and a circular flange 104 on the other leg 106. The male portion 100 of the elbow 98 is press fit into the passageway 114. The flange 104 has a flat surface 108 which can be borne facially against the inside surface 90 of the closure 12 and secured therethrough as through a threaded fastener 110. In this embodiment, the fastener 110 is integrated into a cap 112 with a rounded, exposed side 114 and a stepped opposite side 116. The opposite side 116 has a reduced diameter portion 118 that extends into a part of the closure 12, such as a window, so that an annular flat portion 119 bears facially against the outside thereof.

The tubular element 78 has a rectangular opening 120 through the wall 82. The opening 120 is a blind opening. In other words, there is no opening through the wall 82 diametrically opposite to the location of the opening 120. The opening 120 is bounded by a continuous edge 122. The opening 130 is dimensioned to accommodate an actuating assembly at 124 on the operating mechanism 16, and consisting of a frame 126, an actuating element 128, and the aforementioned second link 30.

The frame 126 has a wall 130 with a surface 132 that is curved to substantially match the curvature of the radially outwardly facing surface 92 on the tubular element 78. A flange 134 projects away from the surface 132 and has an outer peripheral surface 136 that nominally matches the shape and dimension of the edge 122 bounding the opening 120 through the tubular element 78. The flange 134 has spaced tabs 138,140, which define surfaces 142,144 which each face the surface 132. The tabs 138,140 have the same configuration. Exemplary tab 138 has a ramp surface 146 which is angled relative to the planes of the surfaces 132,142,144. The tab 140 has a like ramp surface 148.

Figure 9:
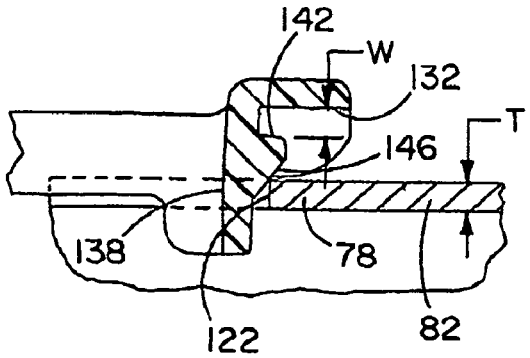
FIG. 9 is an enlarged, fragmentary, cross-sectional view of a portion of the frame in FIG. 8 as it is being pressed into an opening in the tubular element as shown in FIG. 8.
Figure 10:
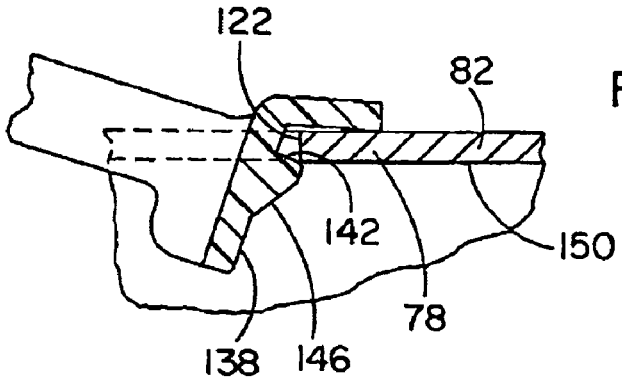
FIG. 10 is a view corresponding to that in FIG. 9 wherein the frame is pressed further into the opening.
Figure 11:
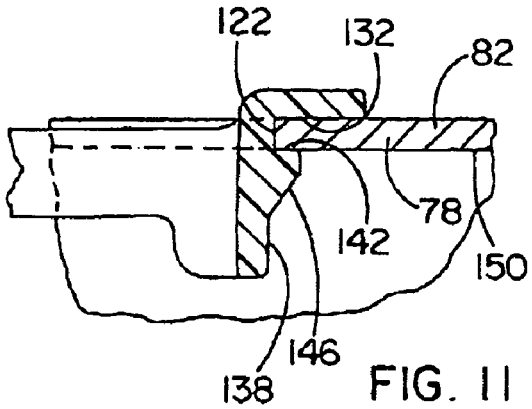
FIG. 11 is a view as in FIGS. 9 and 10 wherein the frame is fully seated within the opening and the frame operatively engaged with the tubular element.

The frame 126 can be pressed into operative engagement with the base 26, as shown in FIGS. 7, 11 and 24–30, by aligning the flange 134 with the opening 120 and pressing the frame 126 radially inwardly, as shown in FIG. 9. Continued inward pressure causes the ramp surface 146 on the exemplary tab 138 to be cammed against the edge 122 and thereby moved towards the center of the opening 120, as shown in an exaggerated manner in FIG. 10. Continued radial movement causes a further deformation until the surface 142 moves radially inwardly beyond the inside surface 150 of the wall 82 on the tubular element 78 and springs back from a deformed state, as seen in FIG. 10, to an undeformed state, as seen in FIG. 11, wherein the edge 122 resides captively between the surfaces 132,142. The thickness T (FIG. 9) of the wall 82 of the tubular element 78 is approximately the same as the width dimension W (FIG. 9) between the surfaces 132,142 on the frame 126. The ability of the tabs 138,140 to deform is made possible by constructing part or all of the frame 126 from a deformable material, such as rubber or plastic. While the frame 126 is shown to be deformable to allow this snap-fit connection of the frame 126 and tubular element 78, part or all of the tubular element 78 could be made deformable to achieve the same end. By reason of using the tabs 138,140 at the axial ends of the opening 120, the frame 126 can be positively maintained in the operative position, as shown in FIGS. 7, 11 and 24–30. Additional tabs or a continuous tab fully around the opening 120, are also contemplated. Further, the snap-fitting of the frame 126 can be alternatively accomplished by initially bending the frame 126 so as to effectively diminish the spacing between the tabs 138, 140, and thereafter directing the frame 126 into the opening 120. By then releasing the frame 126, the tabs 138, 140 seat and the same operative position therefor is realized.

With the frame 126 operatively positioned, the wall 130 and flange 134 cover the edge 122 of the opening 120 to provide a consistently neat appearance, even if the edge 122 has some minor irregularities. Depending upon how the opening 120 is formed, the edge 122 may have a rough shape with potentially sharp and/or jagged portions and/or flash thereon. The frame 126 shields the user from this edge 122 so that the edge 122 is not inadvertently contacted during use, as might otherwise cause discomfort to the user.

The actuating element 128 has a length dimension L and a width dimension W1 that are each slightly less than the corresponding length and width dimensions L1,W2 of an opening 152 bounded by an inside surface 154 of the flange 134 on the frame 126. With this arrangement, the length and width dimensions L,W1, respectively, of the actuating element 128 can be directed through the frame opening 152 through the corresponding length and width dimensions L1,W2.

Figure 25:
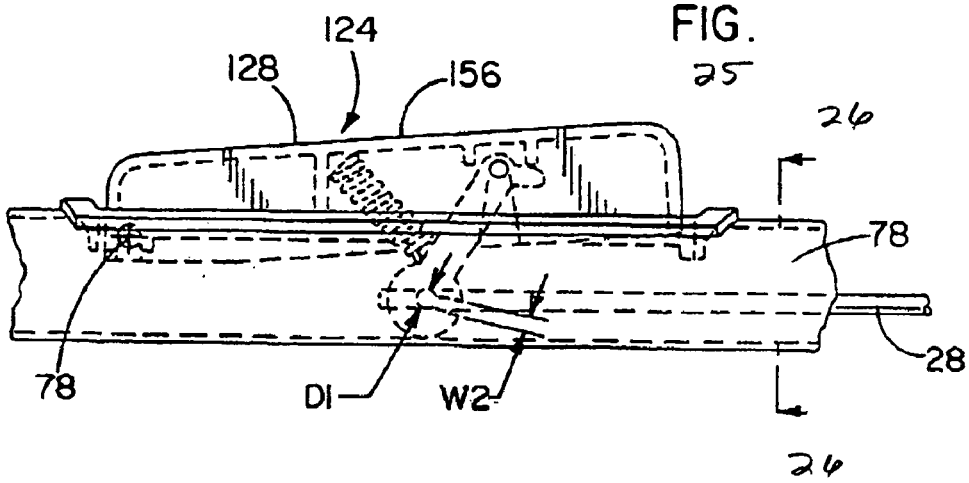
FIG. 25 is an enlarged, fragmentary, side elevation view of the structure shown in FIG. 24.
Figure 26:
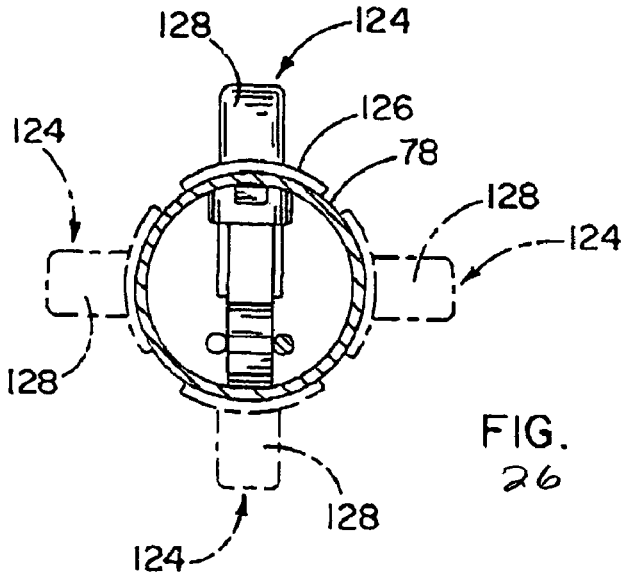
FIG. 26 is an enlarged, cross-sectional view of the tubular element taken along line 26—26 of FIG. 25 and with the actuating assembly and tubular element shown assembled in different angular orientations in phantom lines.
Figure 27:
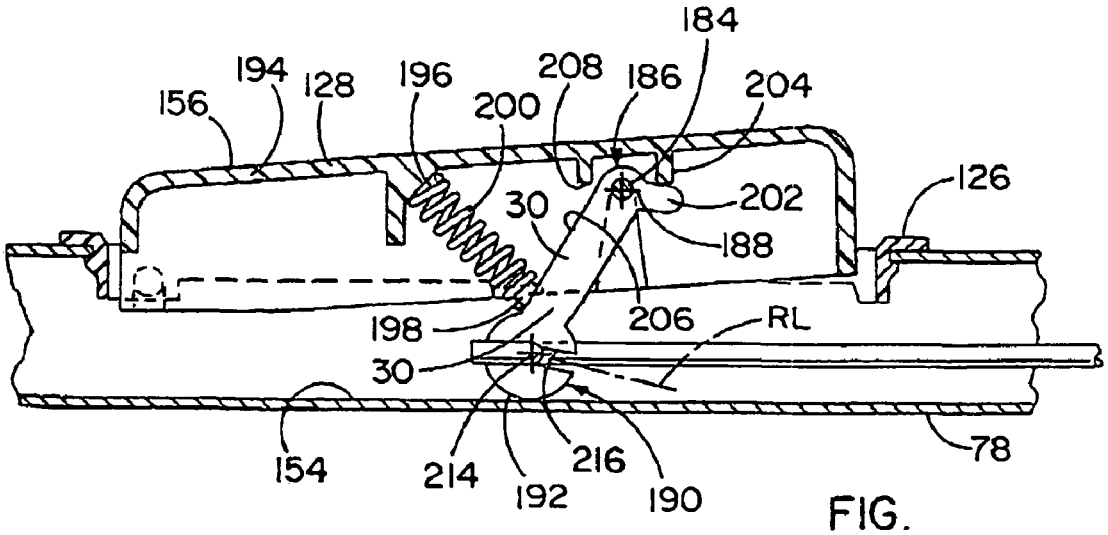
FIG. 27 is an enlarged, fragmentary, cross-sectional view of the tubular element and actuating assembly taken along 27—27 of FIG. 24 with the actuating element in a normal state.
Figure 28:
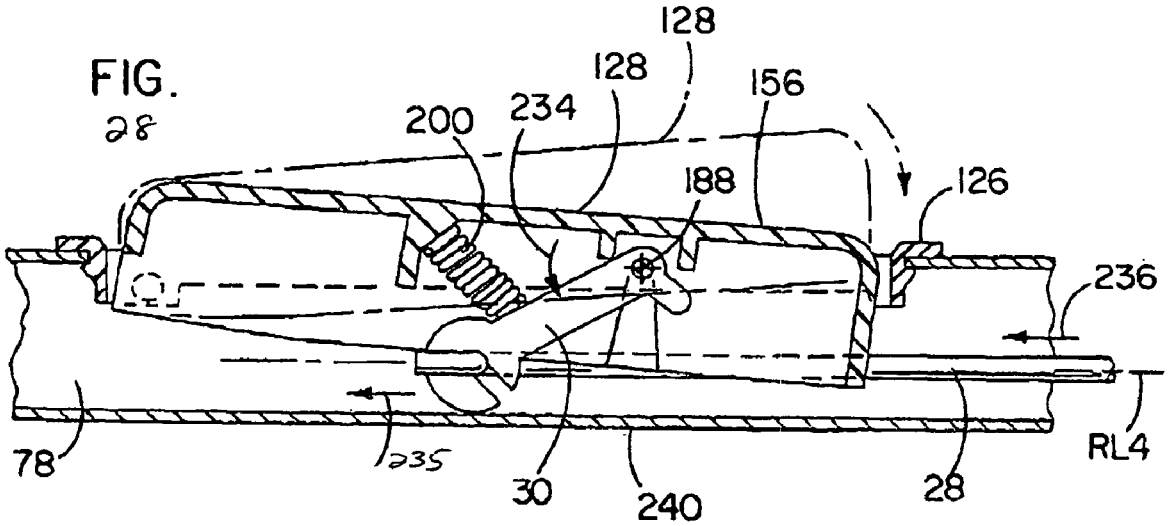
FIG. 28 is a view as in FIG. 27 with the actuating element pressed inwardly into an actuated position.

The actuating element 128 is preferably operatively engaged with the frame 126 before the frame 126 is snap fit to the tubular element 78. The actuating element 128 has an actuating surface 156 that is placed in a leading direction as the actuating element 128 is directed through the frame opening 152 from the inside 158 of the frame 126 to the outside 160 of the frame 126. The frame 126 and actuating element 128 can be relatively angularly reoriented, and otherwise relatively moved with the actuating element 128 extending into the opening 152, to allow pivot stub shafts 162,164, which project towards each other from the flange 134 on the frame 126 across the width of the opening 152, to be extended into openings 166,168, respectively, in spaced walls 170,172 on the actuating element 128. The walls 170,172 have undercut guide slots 174,176, respectively, which converge outwardly towards the openings 166,168, to guide the pivot stub shafts 162,164 into alignment with the openings 166,168. The spacing between the walls 170,172 is selected so that as the pivot stub shafts 162,164 move within the guide slots 174,176, the walls 170,172 are compressed slightly towards each other by the pivot stub shafts 162, 164. Once the pivot stub shafts 162,164 move up to the openings 166,168, the walls 170,172 relax to cause the pivot stub shafts 162,164 to seat in the openings 166,168. With the actuating element 128 assembled in this manner, the pivot stub shafts 162,164 cooperatively define a pivot axis at 178 for the actuating element 128, which is movable therearound between a normal position, as shown in FIGS. 7, 23, 25, 27 and 28, and an actuated position, as shown in FIGS. 26 and 28. The walls 170,172 have projecting tabs 180,182 which abut to the inside surface 154 of the tubular element 78 to arrest pivoting of the actuating element 128 from the actuated position outwardly to beyond the normal position.

The link 30 is mounted between the walls 170,172 and is maintained in position by a pivot pin 184, which spans between the walls 170,172 and guides a mounting end 186 of the link 30 in pivoting movement around an axis 188, that is substantially parallel to the axis 178. The link 30 has an actuating end 190 with a curved edge 192 that bears against the inside surface 154 of the tubular element 78 at a location diametrically opposite to the location of the opening 120.

A wall 194 on the actuating element 128, spanning between the walls 170,172, and defining the actuating surface 156, has a cantilevered post 196 that projects therefrom in a first direction. The link 30 has a corresponding cantilevered post 198 projecting therefrom generally oppositely to the first direction. The lines of projection of the posts 196,198 nominally coincide so that a compression coil spring 200 can be mounted over the posts 196,198 to act between the wall 194 and link 30 in compression. The spring 200 biases the link 30 in one direction in movement around the axis 188. Movement in this direction is limited by the abutment of an arm 202 on the link 30 to a stop tab 204 projecting inwardly from the wall 194 of the actuating element 128. Opposite pivoting movement of the link 30 is limited by abutment of an edge 206 on the link to a separate stop tab 208 projecting inwardly from the wall 194 on the actuating element 128.

The actuating assembly 124, consisting of the frame 126, actuating element 128, link 30, and spring 200, can be preassembled preparatory to installation by radial movement through the opening 120 in the tubular element 78. The actuating assembly 124 can be directed radially, as a unit, to be snap fit into, and maintained in, operative engagement with the tubular element 78. The actuating assembly 124 can thus be assembled without requiring any separate fasteners in a simple press fit step through the blind opening 120 to maintain the operative engagement between the actuating assembly and the tubular element 78.

It is further possible to operatively connect the at least one link 28 to the link 30 without requiring separate fasteners. To make this possible, the link 30 is provided with a receptacle 210 to receive a part 212 of the link 28 so as to guide the part 212 and link 30 in relative movement around an axis 214. The link 30 has a slot 216 in communication with the receptacle 210 and projecting radially therefrom along a reference line RL, as seen in FIG. 25. The slot 216 permits a modicum of flexing of the link 30 to allow a slight, effective enlargement of the diameter D of the receptacle 210, and also accommodates the part 212, during assembly. The significance of this is explained below.

As seen in FIGS. 8 and 15–17, the link 28 has an elongate part 218 with a length that extends along a reference line RL2. The elongate part 218 has a straight section 220 which joins to the part 212. The part 212 is straight and extends along a reference line RL3, which is generally orthogonal to the reference line RL2. The end of the part 212 remote from the straight section 220 is return bent to define a straight, free end section 224 that projects along a reference line RL4, which is shown to be orthogonal to the reference line RL3 and substantially parallel to the reference line RL2. The free end section 224 terminates at a free end 226.

Figure 15:
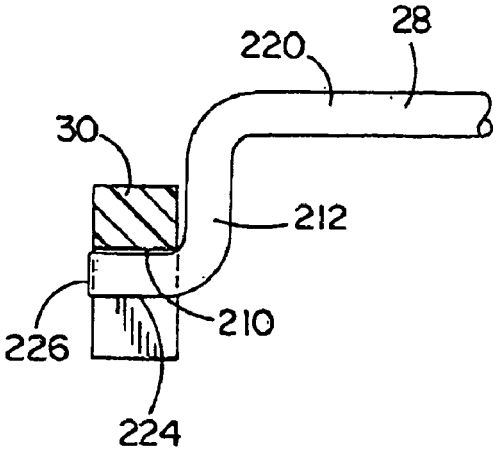
FIGS. 15–17 are enlarged, fragmentary views sequentially showing the steps of connecting the two links on the inventive operating mechanism.
Figure 16:
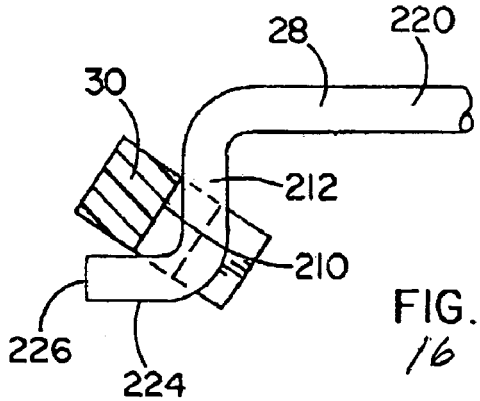
Figure 17:
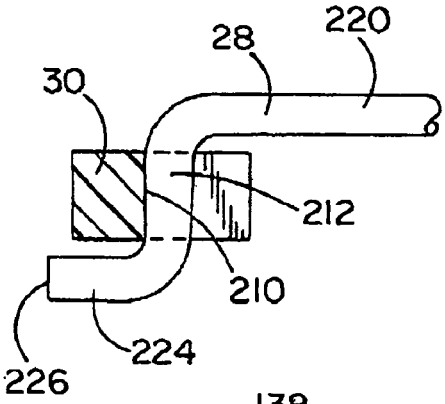
Figure 18:
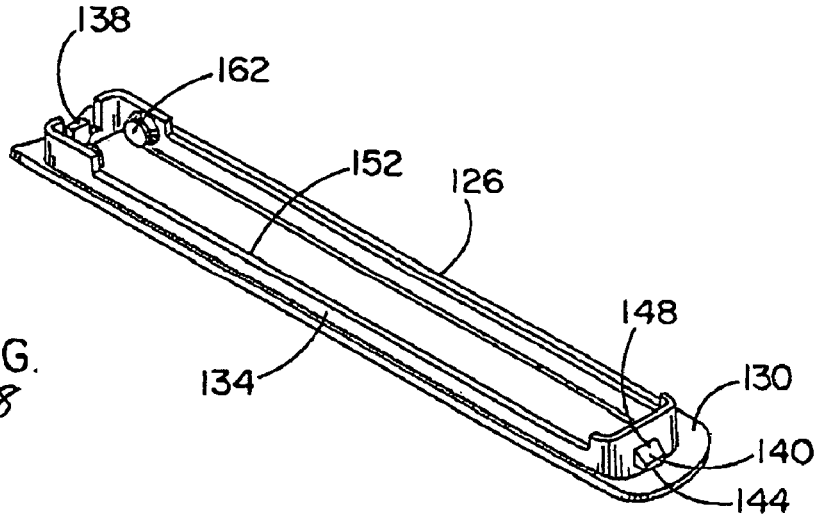
FIG. 18 is an enlarged, inside, perspective view of the frame on the inventive actuating assembly.
Figure 19:
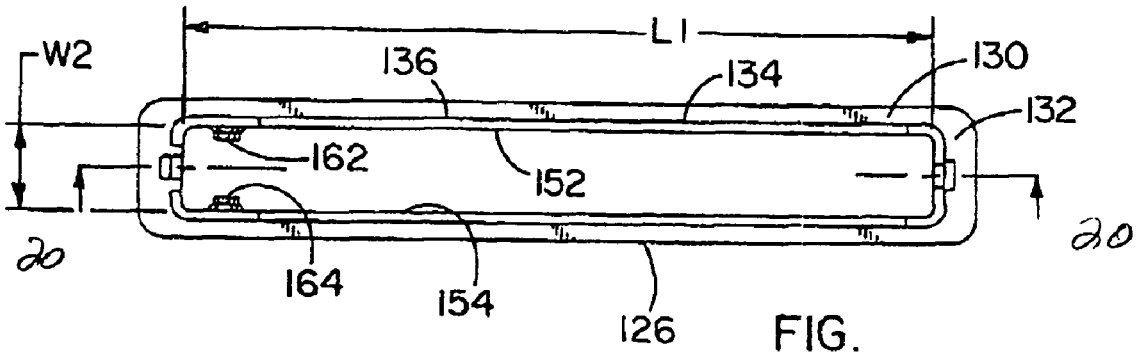
FIG. 19 is an enlarged, inside view of the frame in FIG. 18.
Figure 20:
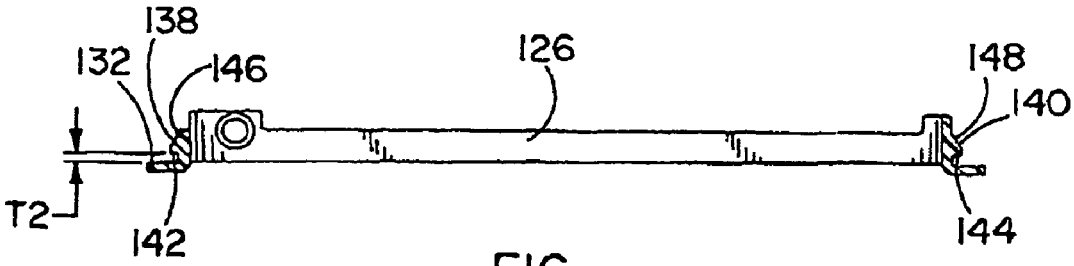
FIG. 20 is an enlarged, cross-sectional view of the frame taken along lines 20—20 of FIG. 19.
Figure 21:
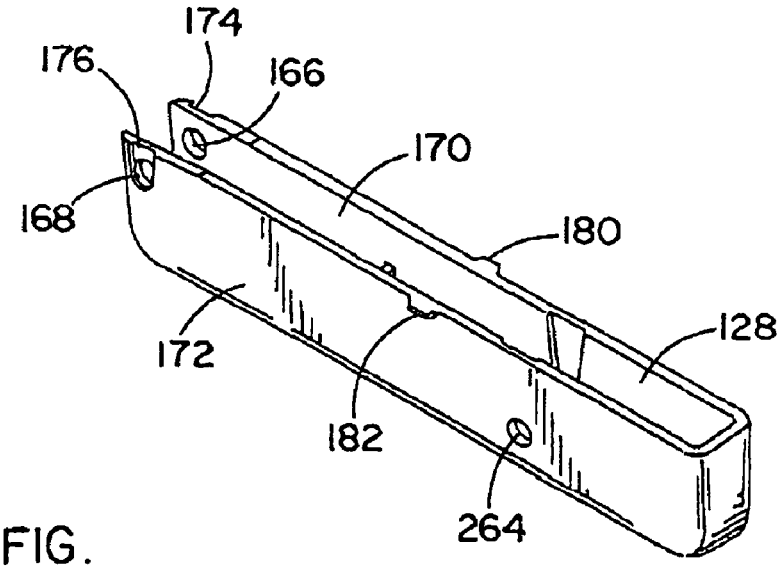
FIG. 21 is an enlarged, inside, perspective view of the actuating element on the inventive actuating assembly.
Figure 22:
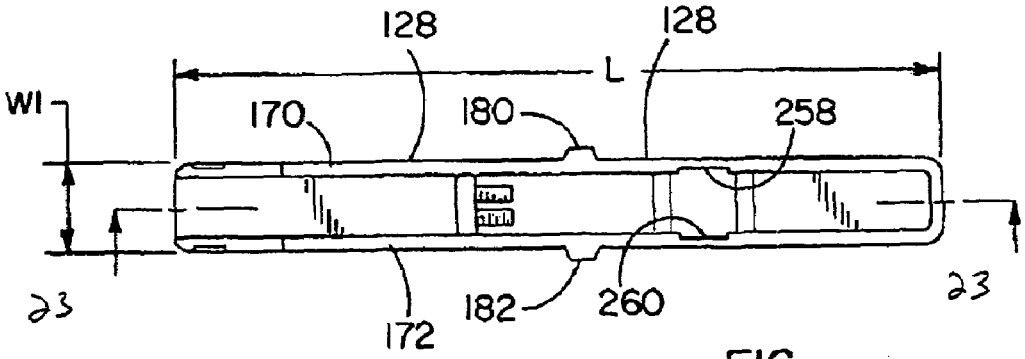
FIG. 22 is an enlarged, inside view of the actuating element in FIG. 21.
Figure 23:
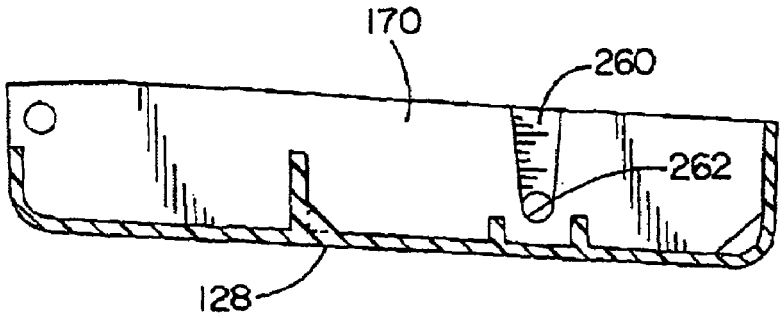
FIG. 23 is an enlarged, cross-sectional view of the actuating element taken along line 23—23 of FIG. 22.
Figure 24:
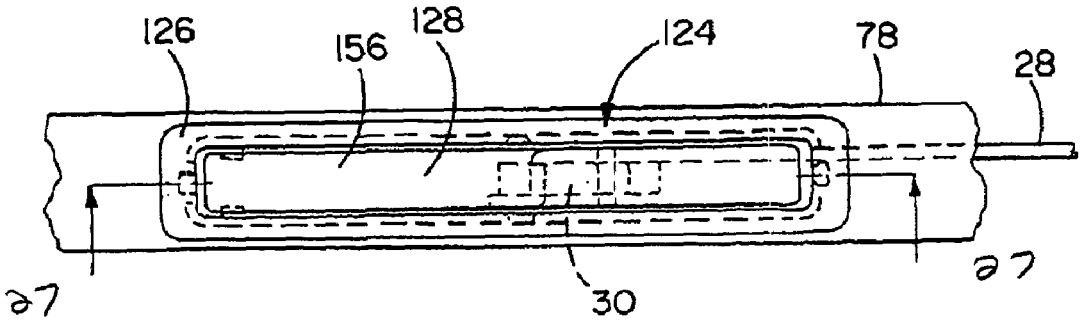
FIG. 24 is an enlarged, fragmentary, plan view of the inventive actuating assembly operatively connected to the tubular element.

The connection of the link 28 to the link 30 is accomplished by directing the straight section 220 of the link 28 through the receptacle 210 while strategically relatively angularly and translationally reorienting the links 28,30. As seen in FIG. 15, the links 28,30 are initially relatively oriented so that the free end 224 can be translated through the receptacle 210 to the point that the part 212 abuts to the link 30. The links 28,30 are reoriented as shown in FIG. 16 and then ultimately moved to the position shown in FIG. 17. In FIG. 16, the relative movement of the links 28,30 causes a wedging action which deforms the link 30 in the slot region to allow passage of the part through the receptacle 210 to the FIG. 17 position. This deformation is permitted by the provision of the slot 216, which also receives a part of the straight section 220 during the assembly process, as shown in FIG. 16. With this construction, the actuating assembly 124 can be preassembled. With the actuating assembly 124 preassembled, the link 30 can be operatively connected to the link 28, as shown in FIGS. 15–17, after which the actuating assembly 124 can be press fit into its operative position on the tubular element 78.

As seen in FIGS. 4 and 5, the end 232 of the at least one link 28, remote from the free end 226, has a bent configuration similar to that adjacent to the free end 226 of the link 28. The end 232 is preferably preassembled to the operator 58 before installation of the actuating assembly 124 takes place. With the end 232 of the at least one link 28 connected, the opposite free end 226 resides axially along the tubular element at a location to register with the opening 120. The link 30 can be connected to the link 28, accessed through the opening 120, preparatory to snap-fitting the actuating assembly 124 in place.

With the links 28,30 operatively connected, and the actuating assembly 124 snap fit in place, the edge 192 of the link is loaded against the radially inwardly facing surface 154 on the tubular element 78 through the spring 200. The spring 200 likewise biases the actuating element 128 to the normal position, as shown in FIGS. 7 and 24–27.

By pressing inwardly on the surface 156 of the actuating element 128 at a location remote from the pivot axis 178, the actuating element 128 is pivoted to the actuated position of FIG. 28. This movement is resisted by the link 30, which is biased by the spring 200 in the direction of the arrow 234 around the axis 188. As the actuating element 128 changes from the normal position into the actuated position, the link 30 is changed from a first orientation, as shown in FIG. 27, into a second orientation as shown in FIG. 28. This causes the receptacle 210 with the part 212 therein to shift along the axis 80 of the tubular element 78 in the direction of the arrow 235. The link 30 thus draws the link in the same axial direction, as indicated by the arrow 236. Thus a force in tension is exerted along a reference line RL4 that is between, and generally parallel to, the reference lines RL2,RL4. The parts are dimensioned so that the requisite movement of the operator 58 is imparted to effect the required pivoting around the axis 62 to change the state of the latch system 18.

The slot 216 is oriented so that the line RL thereof is not parallel to the force line RL4, as might tend to draw the part 212 radially through the slot 216. The diameter D1 of the part 212 is greater than the width W of the slot 216 so that separation of the part 212 from the link 30 will not occur.

Figure 29:
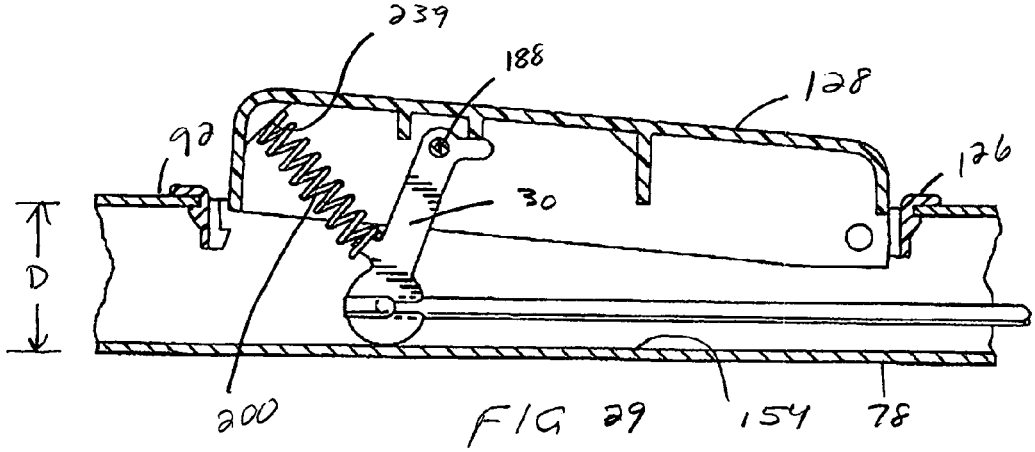
FIGS. 29 and 30 correspond respectively to FIGS. 27 and 28, with the actuating assembly assembled in a reversed orientation.
Figure 30:
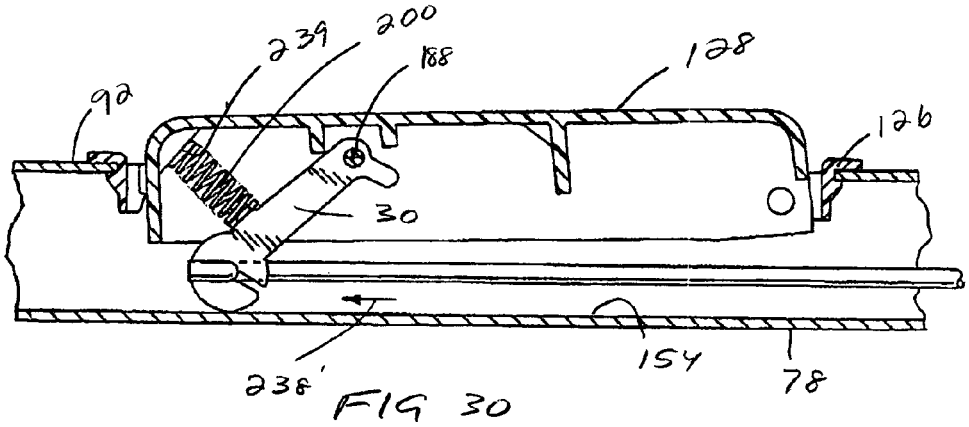

As shown in FIGS. 29 and 30, the pivot direction for the actuating element 128 around the axis 78 may be reversed by reversing the mounting position of the frame 126 within the opening 120. This reversal is accommodated by also reversing the orientation of the link 30 relative to the actuating element 128 around the axis 188. A corresponding movement of the actuating element 128, between normal and actuated positions, causes the link 30 to be moved guidingly against the inside surface 154 of the tubular element 78, axially in the direction of the arrow 238, so as to shift the link 28 in the same axial direction. To accommodate the reversal of the link 30, the spring 200 acts against a corner surface 239 on the inside of the actuating element 128. In each of the arrangements shown in FIGS. 27 and 28 and FIGS. 29 and 30, the movement of the actuating element 128 from the normal position into the actuated position effects a translation of the at least one link 28 from a first position into a second position to actuate a latch system and change the latch system from a latched state into a released state.

The actuating element 128 and tubular element 78 are configured so that an operator can extend a hand around the actuating element 128 and tubular element 78 so as to exert a squeezing force on the surface 156 and a portion of the tubular element 78 at 240 that is diametrically opposite to the surface 156. By effecting this squeezing action, the latch system 18 can be placed in the released state, whereupon the user can change the position of the closure 12 by conveniently manipulating the grasped tubular element 78.

As shown in FIG. 26, the opening 120 can be located at any angular position around the circumference of the tubular element 78 for ease of operation, as dictated by a particular application.

With the axial end 84 of the tubular element 78 connected to the support/housing part 42, as shown in FIG. 5, the orientation of the length of the tubular element 78 relative to the housing 38 can be changed selectively, as between the horizontal arrangement, as shown at A in FIG. 2, to a vertical arrangement, as shown in phantom lines at B in FIG. 2, as well as to other positions therebetween.

Figure 31:
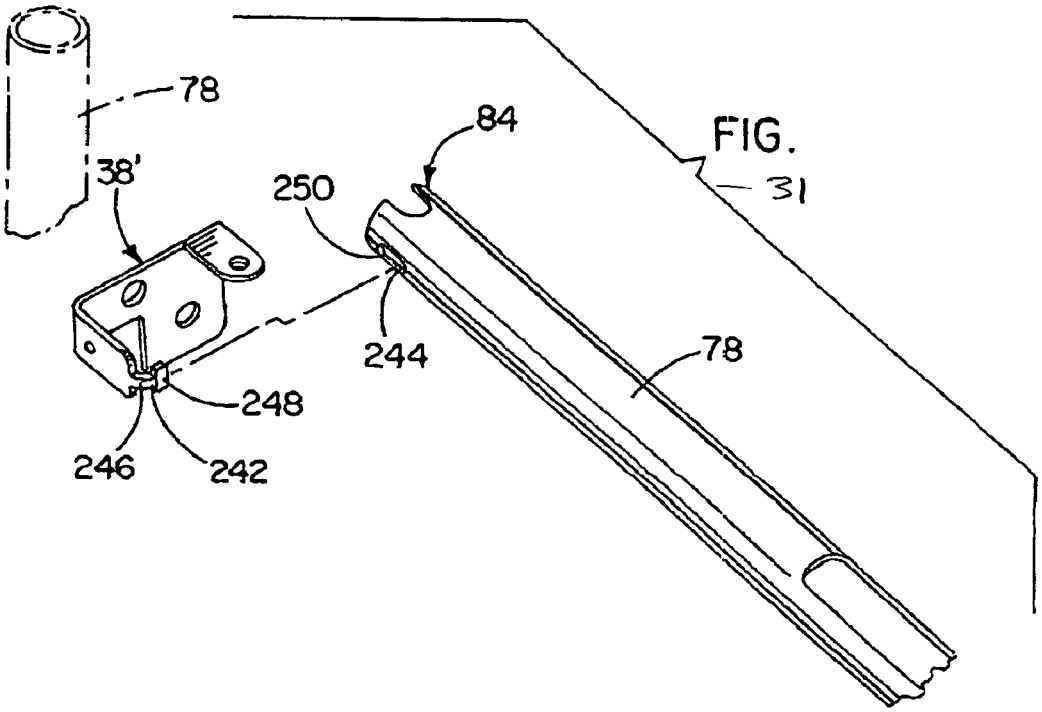
FIG. 31 is an enlarged, fragmentary, perspective view of a modified form of support on a latch system, according to the invention, and having an integral mounting post to operatively connect an end of the tubular element to situate the tubular element in different orientations.
Figure 32:
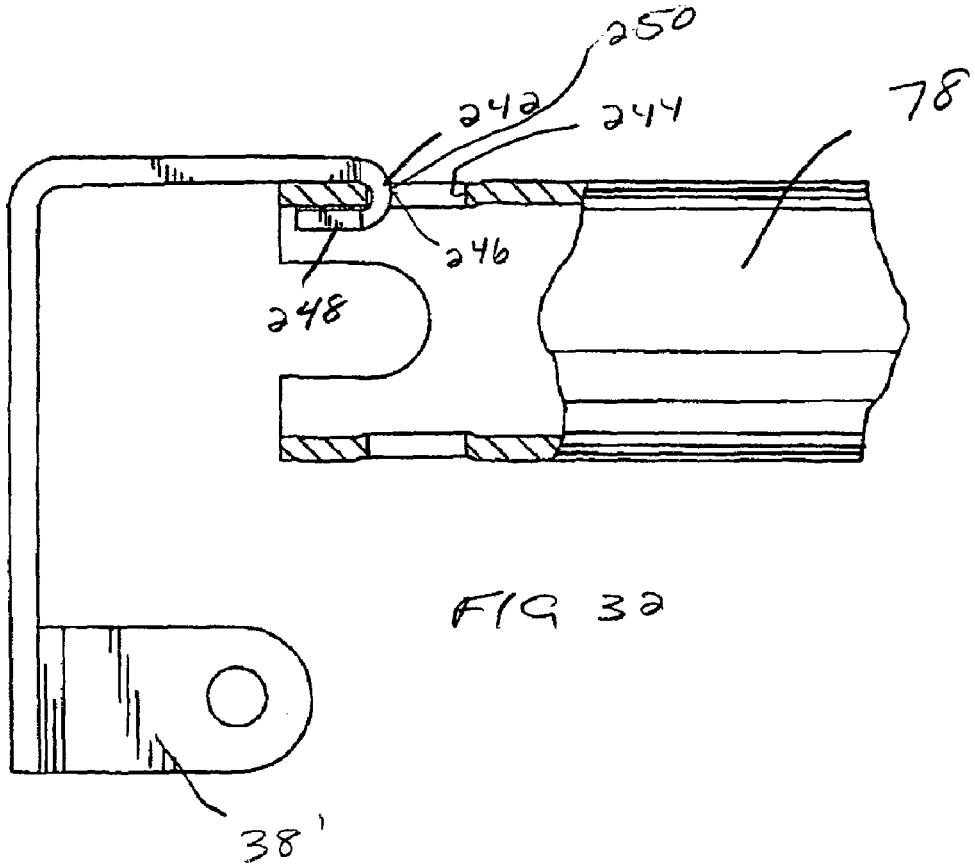
FIG. 32 is an enlarged, fragmentary, partial cross-sectional view of the connection between the mounting post and tubular element in FIG. 31.

As an alternative to using the bolt 94 as shown in FIG. 4, a modified form of housing support 38' for mounting the tubular element 78 may be provided, as shown in FIGS. 31 and 32. The housing 38' has an integral T-shaped mounting post 242 that can be directed into an oval opening 244 having its major axis aligned with the length of the tubular element 78. The mounting post has a stem 246 and a cross bar 248. By aligning the length of the cross bar 248 with the major axis of the opening 244, the cross bar 248 can be projected through the opening 244. The tubular element 78 can be shifted axially to abut the stem 246 against the edge 250 of the opening 244 adjacent the axial end 84 of the tubular element 78. Once this occurs, the tubular element 78 can be oriented as shown in solid lines in FIGS. 31 and 32, or with the length extending at an angle 900 to the orientation of the length of the tubular element 78, as shown in phantom lines in FIG. 31. In either position, with the stem 246 against the opening edge 250, the tubular element 78 is maintained against separation from the housing/support 38' by the mounting post 242. As shown in FIG. 32, the mounting part 242 can be bent to be wrapped conformingly against the edge 250 to more positively fix the connection between the tubular element 78 and housing support 38'. Once the support 88 is fixed in place, the relative positions of the tubular element 78 and housing 38' are maintained so that no separate fasteners are required to maintain the end 84 of the tubular element 78 attached to the housing 38'.

Figure 33:
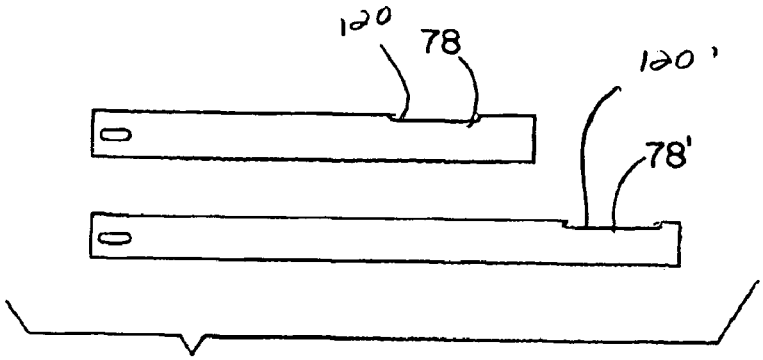
FIG. 33 is an elevation view of two alternative forms of interchangeable tubular elements which can be sold as a kit for the inventive operating mechanism.

The invention also makes possible the provision of a kit with tubular elements 78,78', as shown in FIG. 33, having different lengths, and with the aforementioned openings 120, 120'. The tubular elements 78,78' can be selectively installed either at the point of manufacture or on site to configure the operating mechanism 16 as desired for a particular application.

Figure 12:
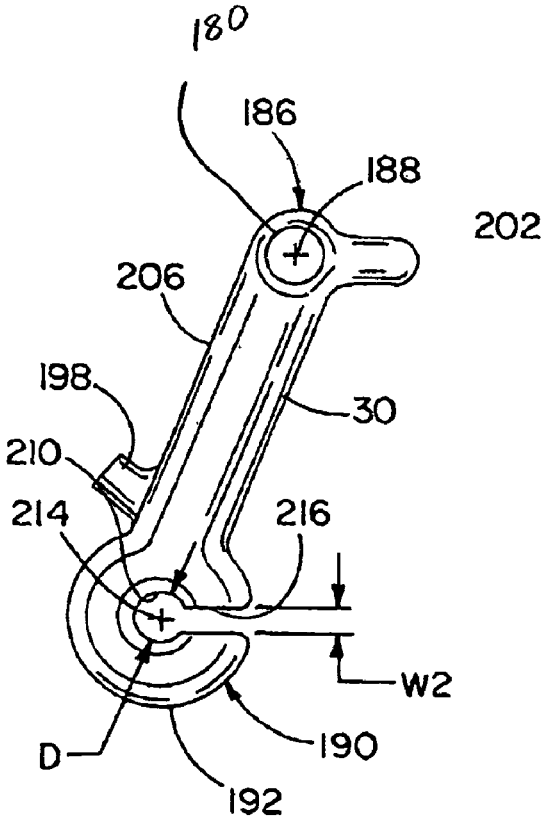
FIG. 12 is an enlarged, side elevation view of the link element on the actuating assembly in FIG. 8.
Figure 13:
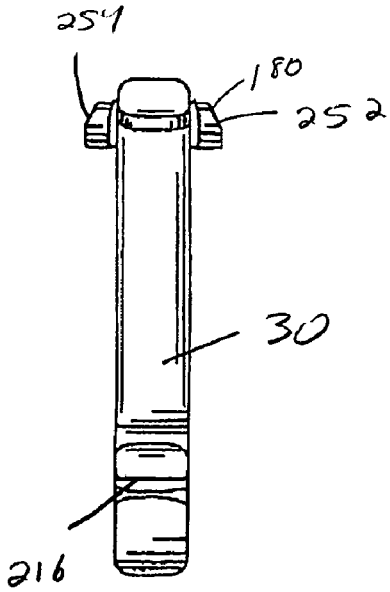
FIG. 13 is an enlarged, end elevation view of the link element in FIG. 12.
Figure 14:
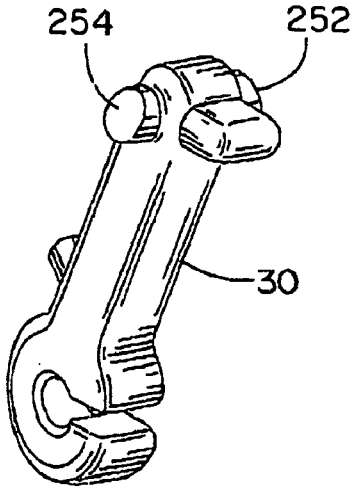
FIG. 14 is an enlarged, perspective view of the link element in FIGS. 12 and 13.

As see in FIGS. 12–14, the link 30 preferably has integrally formed, oppositely projecting, stub shaft portions 252,254 that define the pivot pin 184, which permit installation of the link 30 without the requirement of a separate pivot pin. Of course, a separate pivot pin is also contemplated. To facilitate installation of the link 30, the legs 170,172 are provided with undercuts 258,260, respectively, each with a diminishing width which converges towards openings 262,264, to receive the stub shaft 252,254. Thus, connection of the link 30 to the actuating element 128 can be simply effected by sliding the link 30 controllably against the actuating element 128.

As shown in FIGS. 4 and 6, optional, redundant operation of the latch system 18 can be effected through a separate, in this case external, actuator 268. The actuator 268 is mounted to the closure 12 using an angled reinforcing plate 270 and bolts 272. The actuator 268 in this embodiment has a pivotable actuating handle 274 which is repositionable to move an actuating element 276 in such a manner as to reposition a post 278 on a latch element 280 so as to change the latch system 18 from the latched state into the released state. This mechanism is shown in U.S. patent application Ser. No. 10/316,359, referenced above.

In this embodiment, as show in FIGS. 4 and 6, the latch element 280 is mounted upon an axle 290 for pivoting movement around an axis 292. The latch element 280 has an L shape with an actuating leg 294 and a catch leg 296. The latch element 280 is biased towards the FIG. 6 position by the coiled torsion springs 66, 68, wrapped respectively around the axle 290 and a spaced axle 302. In the FIG. 6 position, the latch element 280 releasably maintains the rotors 48, 50 in the latched positions therefor. By pivoting the latch element 280 in the direction of the arrow 304 around the axle 290, against the bias of the springs 66, 68, the rotors 48, 50 are allowed to pivot into their released positions. As previously noted, this action can be effected either a) through the aforementioned operator 58 by pivoting the same to cause an edge 306 to bear on an edge 308 on the latch element 280 or b) by causing the actuating element 276 to reposition the post 278 on the latch element 280.

Figure 34:
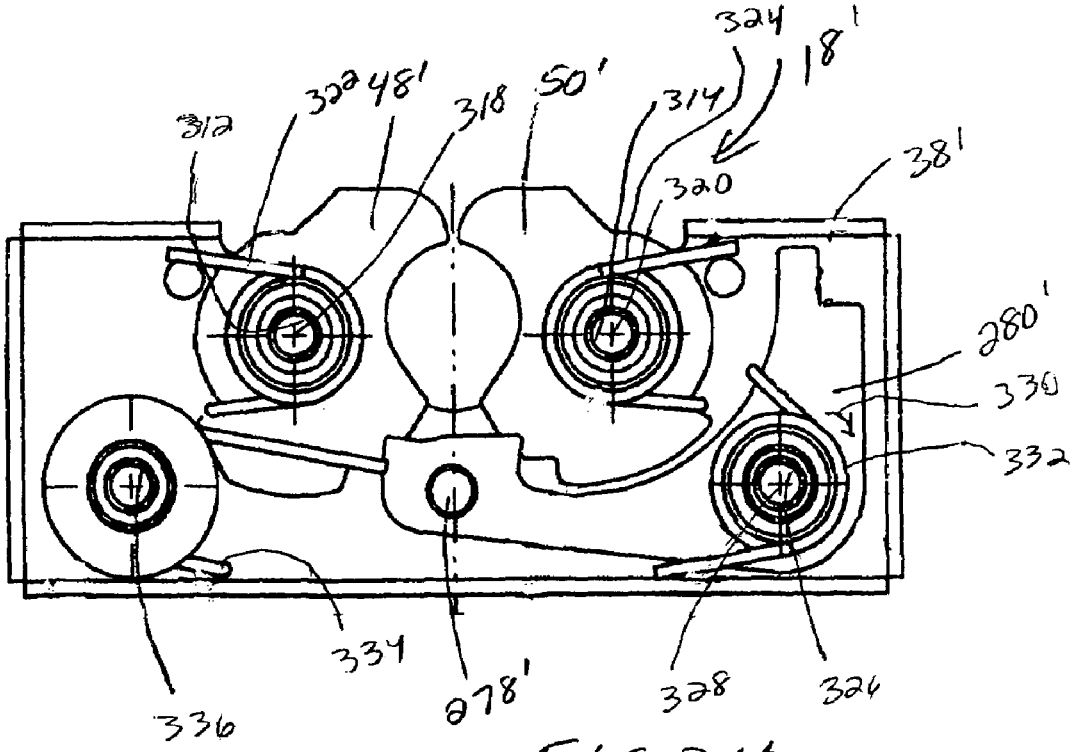
FIG. 34 is a view as in FIG. 6 of a modified form of latch system which is usable with the present invention.

As previously mentioned, the precise configuration of the latch system 18 is not critical to the present invention. An exemplary, modified form of latch assembly, usable with the present invention, is shown at 18' in FIG. 34. The latch system 18' has a housing 38' which mounts rotors 48', 50' for pivoting movement between latched and released positions. In this embodiment, the rotors 48', 50' are mounted upon axles 312, 314 for pivoting movement around axes 318, 320, respectively. Torsion coil springs 322, 324 bias the rotors 48', 50' towards their released positions.

An L-shaped latch element 280' is mounted on an axle 326 for pivoting movement around an axis 328. The latch element 280' is normally biased in the direction of the arrow 330 in FIG. 34 around the axis 328 into a position wherein the latch element 280' maintains the rotors 48', 50' in a latched position. By reversely pivoting the latch element 280', the rotors 48', 50' are allowed to move to their released positions. The latch element 280' is biased into the position of FIG. 34 by a coiled torsion spring 332 on the axle 326 and a separate, coiled torsion spring 324 on a spaced axle 336. The latch element 280' has a post 278', corresponding to the post 278, that can be acted against, as by the actuating element 276, to reposition the latch element 280'.

The invention also contemplates utilizing latch systems that may have a single rotor or other types of latching mechanism.

Figure 35:
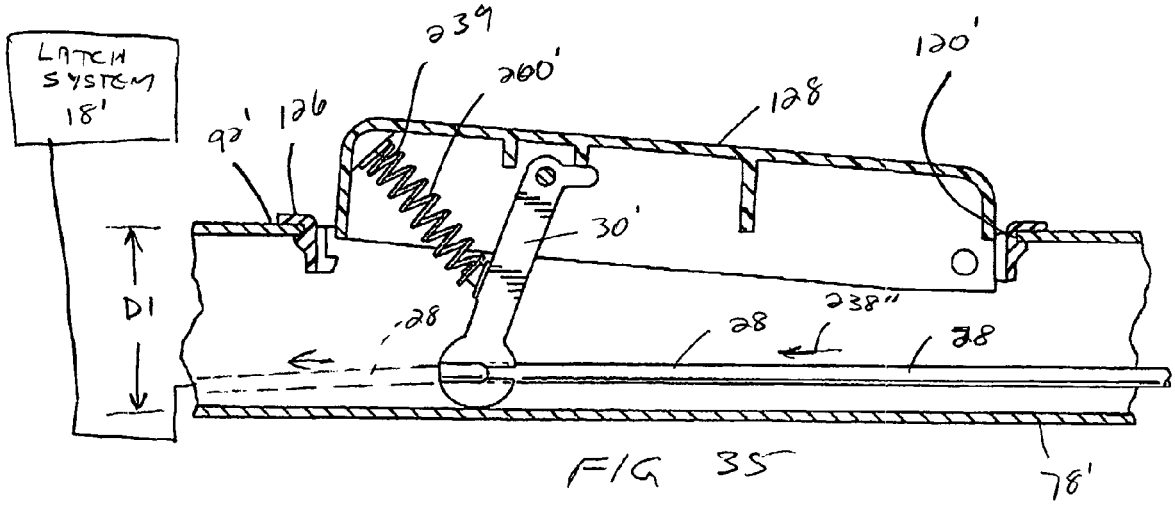
FIG. 35 is a view as in FIGS. 29 and 30 with a larger diameter of tubular element and a different configuration of link element than shown in FIGS. 12–14.

Another variation of the present invention is shown in FIG. 35. In FIG. 35, the frame 126 and actuating element 128 are mounted within an opening 120' in a tubular element 78'. The tubular element 78' has a diameter D1 that is larger than the corresponding diameter D for the tubular element 78 (see FIG. 29). As one example, D may be on the order of 25 mm, with D1 on the order of 32 mm. By reason of the frame 126 being made from a deformable material, the frame 126 will conform to the outside surface 92' of the larger diameter tubular element 78', to facilitate operative mounting thereof. Thus, a single configuration of frame 126 will be usable for a range of diameters of tubular element 78, 78'.

In FIG. 35, the link 30' is mounted as in FIGS. 29 and 30 and is biased using a coil spring 200'. To accommodate the larger diameter tubular element 78', the link 30' is made slightly longer than the link 30. The link 30' can be snap fit into its operative position on the actuating element 128 in the same manner as for the link 30. The coil spring 200' acts between the link 30' and the corner surface 239 on the actuating element 128.

As also shown in FIG. 35, the link 28, while shown to cause the link 28 to be moved in the direction of the arrow 238" so that it operates in tension, as shown in phantom lines, the link 28 can be placed in compression between the link 30' and a latch system 18' corresponding to the latch system 18.

While the invention has been described with particular reference to the drawings, it should be understood that various modifications could be made without departing from the spirit and scope of the present invention.

The invention claimed is:

1. An operating mechanism for a movable closure element to releasably engage a strike assembly on a frame support and thereby releasably maintain a movable closure element on which the operating mechanism is mounted in a predetermined position relative to the frame support, the operating mechanism comprising:

a base comprising an elongate portion with a first axis and a wall extending around the first axis and defining an elongate tubular passageway;

a latch system on the base and having (a) a latched state in which the latch system engages a strike element on the strike assembly so as to maintain a movable closure element on which the operating mechanism is mounted in the predetermined position and (b) a released state wherein the latch system can be disengaged from a strike element so as to allow a movable closure element on which the operating mechanism is mounted to be moved from the predetermined position; and an actuating system on the base and changeable from a first state into a second state to thereby change the latch system from the latched state into the released state, the actuating system comprising at least a first link which is movable axially within the passage from a first position into a second position to thereby change the latch system from the latched state into the released state, the actuating system further comprising an actuating assembly for the at least first link that can be directed radially through the wall on the base into operative engagement with the base without requiring separate fasteners to maintain the operative engagement between the actuating assembly and the base, the actuating system comprising an actuating element that is pivotable relative to the base to thereby cause the first link to move from the first position into the second position.

2. The operating mechanism for a movable closure element according to claim 1 wherein the actuating system comprises a second link that can be operatively engaged with the at least first link within the passageway without requiring separate fasteners.

3. The operating mechanism for a movable closure element according to claim 2 wherein a spring element acts between the actuating element and second link to urge the actuating element in pivoting movement relative to the base.

4. The operating mechanism for a movable closure element according to claim 1 wherein the base comprises a tubular element that defines the elongate tubular passage and elongate portion and first and second supports for the tubular element that are spaced axially relative to the first axis.

5. The operating mechanism for a movable closure element according to claim 1 in combination with a movable closure element to which the operating mechanism is attached.

6. The operating mechanism for a movable closure element according to claim 5 further in combination with a frame support having a strike assembly, the movable element mounted for movement between the predetermined position and a second position, with the latch system engaging the strike assembly with the movable element in the predetermined position.

7. The operating mechanism for a movable closure element according to claim 1 wherein the wall has an opening bounded by an edge and the actuating system further comprises a frame with a wall and a transverse flange that cover the edge so that the edge is not exposed to a user of the operating mechanism.

8. The operating mechanism for a movable closure element according to claim 1 wherein the first link is an elongate element with a substantially rigid, fixed shape.

9. The operating mechanism for a movable closure element according to claim 8 wherein the first link has a bent end that can be directed through the first link.

10. The operating mechanism for a movable closure element according to claim 1 wherein the actuating element is configured to be joined to the first link without requiring the use of separate fasteners.

11. An operating mechanism for a movable closure element to releasably engage a strike assembly on a frame support and thereby releasably maintain a movable closure element on which the operating mechanism is mounted in a predetermined position relative to the frame support, the operating mechanism comprising:

a base comprising an elongate portion with a first axis and a wall extending around the first axis and defining a passageway;

a latch system on the base and having (a) a latched state in which the latch system engages a strike element on the strike assembly so as to maintain a movable closure element on which the operating mechanism is mounted in the predetermined position and (b) a released state wherein the latch system can be disengaged from a strike element so as to allow a movable closure element on which the operating mechanism is mounted to be moved from the predetermined position; and an actuating system on the base and changeable from a first state into a second state to thereby change the latch system from the latched state into the released state, the actuating system comprising at least a first link, having a substantially rigid fixed shape, which is movable axially within the passage from a first position into a second position to thereby change the latch system from the latched state into the released state, the actuating system further comprising an actuating assembly for the at least first link that can be directed radially through the wall on the base into operative engagement with the base without requiring separate fasteners to maintain the operative engagement between the actuating assembly and the base, wherein the actuating system comprises a second link that can be operatively engaged with the at least first link without requiring separate fasteners, wherein the second link has a receptacle for supporting a part of the at least first link for pivoting movement about a second axis that is transverse to the first axis.

12. The operating mechanism for a movable closure element according to claim 11 wherein the second link exerts a tensile force on the at least first link as the at least first link is moved from the first position into the second position.

13. The operating mechanism for a movable closure element according to claim 11 wherein the second link exerts a compressive force on the at least first link as the at least first link is moved from the first position into the second position.

14. The operating mechanism for a movable closure element according to claim 11 wherein the at least first link has an elongate portion with a free end and the part of the at least first link is spaced from the free end.

15. The operating mechanism for a movable closure element according to claim 14 wherein the elongate portion has a substantially straight section extending along a first line substantially parallel to the first axis and the part of the at least first link extends transversely to the first line along a second line.

16. The operating mechanism for a movable closure element according to claim 15 wherein the at least first link has a free end section which projects a) along a third line that is transverse to the second line and b) to the free end of the elongate portion.

17. The operating mechanism for a movable closure element according to claim 16 wherein the first and third lines are substantially parallel to each other.

18. The operating mechanism for a movable closure element according to claim 16 wherein the elongate portion of the at least first link is connected to the second link by directing the elongate portion of the at least first link through the receptacle by relatively reorienting the at least first link and second link, while relatively moving the elongate portion of the at least first link and second link along the first and second lines as the elongate portion of the at least first link is directed through the receptacle.

19. An operating mechanism for a movable closure element to releasably engage a strike assembly on a frame support and thereby releasably maintain a movable closure element on which the operating mechanism is mounted in a predetermined position relative to the frame support, the operating mechanism comprising:

a base comprising an elongate portion with a first axis and a wall extending around the first axis and defining a passageway;

a latch system on the base and having (a) a latched state in which the latch system engages a strike element on the strike assembly so as to maintain a movable closure element on which the operating mechanism is mounted in the predetermined position and (b) a released state wherein the latch system can be disengaged from a strike element so as to allow a movable closure element on which the operating mechanism is mounted to be moved from the predetermined position; and an actuating system on the base and changeable from a first state into a second state to thereby change the latch system from the latched state into the released state, the actuating system comprising at least a first link which is movable axially within the passage from a first position into a second position to thereby change the latch system from the latched state into the released state, the actuating system further comprising an actuating assembly for the at least first link that can be directed radially through the wall on the base into operative engagement with the base without requiring separate fasteners to maintain the operative engagement between the actuating assembly and the base, wherein the actuating system comprises a second link that can be operatively engaged with the at least first link without requiring separate fasteners, wherein the second link has a receptacle for supporting a part of the at least first link for pivoting movement about a second axis that is transverse to the first axis, wherein the second link has a slot communicating with the receptacle and extending radially relative to the second axis from the receptacle.

20. The operating mechanism for a movable closure element according to claim 19 wherein the actuating assembly comprises an actuating element that is repositionable relative to the base between a normal position and an actuated position, and the second link is connected to the actuating element.

21. The operating mechanism for a movable closure element according to claim 20 wherein the second link is connected to the actuating element for relative pivoting movement around a third axis.

22. The operating mechanism for a movable closure element according to claim 21 wherein the third axis is substantially parallel to the second axis.

23. The operating mechanism for a movable closure element according to claim 21 wherein the actuating element is movable relative to the base around a fourth axis.

24. The operating mechanism for a movable closure element according to claim 21 wherein the slot extends radially along a line relative to the second axis from the second axis, the second link is movable relative to the base around a fourth axis between first and second orientations, the second link is in the first orientation with the actuating element in the normal position and in the second orientation with the actuating element in the actuated position, and with the second link in and between the first and second orientations, a line of a force acting between the second link and the part of the at least first link is non-parallel to the line of the slot.

25. The operating mechanism for a movable closure element according to claim 24 wherein the second link has an end that slides axially relative to the first axis guidingly along the wall as the actuating element is repositioned between the normal and actuated positions.

26. The operating mechanism for a movable closure element according to claim 25 wherein the wall has a first opening bounded by an edge with a thickness, the actuating system further comprises a frame with first and second oppositely facing surfaces, the actuating element is mounted for pivoting movement relative to the frame around the fourth axis, and at least a part of the frame is deformable so that as the frame is pressed into the wall, the at least part of the frame changes from an undeformed state into a deformed state to allow the first surface on the frame to move past the edge and thereafter reassume the undeformed state so that the edge of the wall is captive between the first and second surfaces whereupon the actuating assembly is in the operative engagement with the base.

27. The operating mechanism for a movable closure element according to claim 26 wherein the first and second surfaces are spaced by a distance that is approximately the same as the thickness of the edge.

28. The operating mechanism for a movable closure element according to claim 26 wherein the second surface extends substantially fully around the wall opening and bears against a surface on the base that faces radially outwardly relative to the first axis.

29. The operating mechanism for a movable closure element according to claim 26 wherein the wall has an annular, outwardly facing surface and there is no opening in the outwardly facing surface diametrically opposite to the first opening.

30. The operating mechanism for a movable closure element according to claim 29 wherein the actuating system further comprises a spring acting between the actuating element and the second link for normally urging the second link towards the first orientation.

31. The operating mechanism for a movable closure element according to claim 11 wherein the base comprises a first tubular element with an outside surface having a first diameter through which the first opening is formed and further in combination with a second tubular element having an outside surface through which a second opening corresponding to the first opening is formed, the second tubular element having a second diameter that is different than the first diameter, and the frame can be selectively pressed into the first and second openings to place the actuating assembly into operative engagement with the base.

32. The operating mechanism for a movable closure element according to claim 31 wherein the second link has first configuration and further in combination with an interchangeable link having a configuration that is different than that of the second link and that is useable in place of the second link with the actuating assembly in operative engagement with the base using the second tubular element.

33. The operating mechanism for a movable closure element according to claim 24 wherein the part of the at least first link has a diameter, the slot has a width, and the slot width is less than the diameter of the part of the at least first link.

34. The operating mechanism for a movable closure element according to claim 24 wherein the actuating system comprises a frame to which the actuating element is mounted for pivoting movement around the fourth axis and the housing is reversibly mountable in first and second different positions relative to the base so that the actuating element pivots in opposite directions around the fourth axis as the actuating element is repositioned from the normal position into the actuated position with the housing in the first and second different positions.

35. The operating mechanism for a movable closure element according to claim 21 wherein a spring element acts between the actuating element and second link to urge the actuating element towards the normal position.

36. An operating mechanism for a movable closure element to releasably engage a strike assembly on a frame support and thereby releasably maintain a movable closure element on which the operating mechanism is mounted in a predetermined position relative to the frame support, the operating mechanism comprising:

a base comprising an elongate portion with a first axis and a wall extending around the first axis and defining a passageway;

a latch system on the base and having (a) a latched state in which the latch system engages a strike element on the strike assembly so as to maintain a movable closure element on which the operating mechanism is mounted in the predetermined position and (b) a released state wherein the latch system can be disengaged from a strike element so as to allow a movable closure element on which the operating mechanism is mounted to be moved from the predetermined position; and an actuating system on the base and changeable from a first state into a second state to thereby change the latch system from the latched state into the released state, the actuating system comprising at least a first link which is movable axially within the passage from a first position into a second position to thereby change the latch system from the latched state into the released state, the actuating system further comprising an actuating assembly for the at least first link that can be directed radially through the wall on the base into operative engagement with the base without requiring separate fasteners to maintain the operative engagement between the actuating assembly and the base, wherein the base comprises a tubular element that defines the elongate portion and first and second supports for the tubular element that are spaced axially relative top the first axis, wherein the tubular element is releasably connectable to each of the first and second supports to allow selective connection of tubular elements of different configuration to the first and second supports, wherein the latch system is on the first support and the first support and tubular element are configured so that the tubular element can be operatively connected to the first support without requiring separate fasteners.

37. An operating mechanism for a movable closure element to releasably engage a strike assembly on a frame support and thereby releasably maintain a movable closure element on which the operating mechanism is mounted in a predetermined position relative to the frame support, the operating mechanism comprising:

a base comprising an elongate portion with a first axis and a wall extending around the first axis and defining a passageway;

a latch system on the base and having (a) a latched state in which the latch system engages a strike element on the strike assembly so as to maintain a movable closure element on which the operating mechanism is mounted in the predetermined position and (b) a released state wherein the latch system can be disengaged from a strike element so as to allow a movable closure element on which the operating mechanism is mounted to be moved from the predetermined position; and an actuating system on the base and changeable from a first state into a second state to thereby change the latch system from the latched state into the released state, the actuating system comprising at least a first link which is movable axially within the passage from a first position into a second position to thereby change the latch system from the latched state into the released state, the actuating system further comprising an actuating assembly for the at least first link that can be directed radially through the wall on the base into operative engagement with the base without requiring separate fasteners to maintain the operative engagement between the actuating assembly and the base, wherein the base comprises a tubular element that defines the elongate portion and first and second supports for the tubular element that are spaced axially relative to the first axis, wherein the tubular element can be selectively connected to the first support in first and second different, predetermined angular orientations around the first axis.

38. An operating mechanism for a movable closure element to releasably engage a strike assembly on a frame support and thereby releasably maintain a movable closure element on which the operating mechanism is mounted in a predetermined position relative to the frame support, the operating mechanism comprising:

a base comprising an elongate portion with a first axis and a wall extending around the first axis and defining a passageway;

a latch system on the base and having (a) a latched state in which the latch system engages a strike element on the strike assembly so as to maintain a movable closure element on which the operating mechanism is mounted in the predetermined position and (b) a released state wherein the latch system can be disengaged from a strike element so as to allow a movable closure element on which the operating mechanism is mounted to be moved from the predetermined position; and an actuating system on the base and changeable from a first state into a second state to thereby change the latch system from the latched state into the released state, the actuating system comprising at least a first link which is movable axially within the passage from a first position into a second position to thereby change the latch system from the latched state into the released state, the actuating system further comprising an actuating assembly for the at least first link that can be directed radially through the wall on the base into operative engagement with the base without requiring separate fasteners to maintain the operative engagement between the actuating assembly and the base, wherein the base comprises a tubular element that defines the elongate portion and first and second supports for the tubular element that are spaced axially relative to the first axis, wherein the tubular element can be selectively connected to the first support in first and second different, predetermined angular orientations, wherein the tubular element is releasably connectable to the first support without requiring any separate fasteners and with the tubular element connected to the first support and the first and second supports mounted to a closure element, the tubular element and first support cannot be separated from each other.

39. An operating mechanism for a movable closure element to releasably engage a strike assembly on a frame support and thereby releasably maintain a movable closure element on which the operating mechanism is mounted in a predetermined position relative to the frame support, the operating mechanism comprising:

a base comprising an elongate portion with a first axis and a wall extending around the first axis and defining a passageway;

a latch system on the base and having (a) a latched state in which the latch system engages a strike element on the strike assembly so as to maintain a movable closure element on which the operating mechanism is mounted in the predetermined position and (b) a released state wherein the latch system can be disengaged from a strike element so as to allow a movable closure element on which the operating mechanism is mounted to be moved from the predetermined position;

an actuating system on the base and changeable from a first state into a second state to thereby change the latch system from the latched state into the released state, the actuating system comprising at least a first link which is movable axially within the passage from a first position into a second position to thereby change the latch system from the latched state into the released state, the actuating system further comprising an actuating assembly for the at least first link and comprising a second link that can be operatively connected to the at least first link without requiring separate fasteners, the actuating system comprising an actuating element that is pivotable relative to the base to thereby cause the first link to move from the first position into the second position; and a spring element acting between the actuating element and second link to urge the actuating element in pivoting movement relative to the base.

40. The operating mechanism for a movable closure element according to claim 39 in combination with a movable closure element to which the operating mechanism is attached.

41. The operating mechanism for a movable closure element according to claim 40 further in combination with a frame support having a strike assembly, the movable closure element mounted for movement between the predetermined position and a second position, with the latch system engaging the strike assembly with the movable element in the predetermined position.

42. An operating mechanism for a movable closure element to releasably engage a strike assembly on a frame support and thereby releasably maintain a movable closure element on which the operating mechanism is mounted in a predetermined position relative to the frame support, the operating mechanism comprising:

a base comprising an elongate portion with a first axis and a wall extending around the first axis and defining a passageway;

a latch system on the base and having (a) a latched state in which the latch system engages a strike element on the strike assembly so as to maintain a movable closure element on which the operating mechanism is mounted in the predetermined position and (b) a released state wherein the latch system can be disengaged from a strike element so as to allow a movable closure element on which the operating mechanism is mounted to be moved from the predetermined position;

an actuating system on the base and changeable from a first state into a second state to thereby change the latch system from the latched state into the released state, the actuating system comprising at least a first link which is movable axially within the passage from a first position into a second position to thereby change the latch system from the latched state into the released state, the actuating system further comprising an actuating assembly for the at least first link and comprising a second link that can be operatively connected to the at least first link without requiring separate fasteners, wherein the second link has a receptacle for supporting a part of the at least first link for pivoting movement about a second axis that is transverse to the first axis; and a spring element acting between the actuating element and second link to urge the actuating element in pivoting movement relative to the base.

43. The operating mechanism for a movable closure element according to claim 42 wherein the actuating assembly comprises an actuating element that is repositionable relative to the base between a normal position and an actuated position, and the second link is connected to the actuating element.

44. The operating mechanism for a movable closure element according to claim 43 wherein the second link is connected to the actuating element for relative pivoting movement around a third axis.

45. The operating mechanism for a movable closure element according to claim 44 wherein the third axis is substantially parallel to the second axis.

46. The operating mechanism for a movable closure element according to claim 44 wherein the actuating element is movable relative to the base around a fourth axis.

47. The operating mechanism for a movable closure element according to claim 46 wherein the second link has an end that slides axially relative to the first axis guidingly along the wall as the actuating element is repositioned between the normal and actuated positions.

48. The operating mechanism for a movable closure element according to claim 47 wherein the second link is movable selectively reversibly mountable for movement in opposite directions around the fourth axis as the actuating element is changed from the normal position into the release position.

49. The operating mechanism for a movable closure element according to claim 47 wherein the actuating system further comprises a spring acting between the actuating element and the second link for normally urging the second link in movement around the third axis.

50. The operating mechanism for a movable closure element according to claim 47 wherein the second link exerts a tensile force on the at least first link as the at least first link is moved from the first position into the second position.

51. The operating mechanism for a movable closure element according to claim 47 wherein the second link exerts a compressive force on the at least first link as the at least first link is moved from the first position into the second position.

52. The operating mechanism for a movable closure element according to claim 42 wherein the at least first link has an elongate portion with a free end and the part of the at least first link is spaced from the free end.

53. An operating mechanism for a movable closure element to releasably engage a strike assembly on a frame support and thereby releasably maintain a movable closure element on which the operating mechanism is mounted in a predetermined position relative to the frame support, the operating mechanism comprising:

a base comprising an elongate portion with a first axis and a wall extending around the first axis and defining a passageway;

a latch system on the base and having (a) a latched state in which the latch system engages a strike element on the strike assembly so as to maintain a movable closure element on which the operating mechanism is mounted in the predetermined position and (b) a released state wherein the latch system can be disengaged from a strike element so as to allow a movable closure element on which the operating mechanism is mounted to be moved from the predetermined position; and an actuating system on the base and changeable from a first state into a second state to thereby change the latch system from the latched state into the released state, the actuating system comprising at least a first link which is movable axially within the passage from a first position into a second position to thereby change the latch system from the latched state into the released state, the actuating system further comprising an actuating assembly for the at least first link and comprising a second link that can be operatively connected to the at least first link without requiring separate fasteners, wherein the second link has a receptacle for supporting a part of the at least first link for pivoting movement about a second axis that is transverse to the first axis, wherein the second link has a slot communicating with the receptacle and extending radially relative to the second axis from the receptacle.

54. An operating mechanism for a movable closure element to releasably engage a strike assembly on a frame support and thereby releasably maintain a movable closure element on which the operating mechanism is mounted in a predetermined position relative to the frame support, the operating mechanism comprising:

a base comprising an elongate portion with a first axis and a wall extending around the first axis and defining a passageway;

a latch system on the base and having (a) a latched state in which the latch system engages a strike element on the strike assembly so as to maintain a movable closure element on which the operating mechanism is mounted in the predetermined position and (b) a released state wherein the latch system can be disengaged from a strike element so as to allow a movable closure element on which the operating mechanism is mounted to be moved from the predetermined position; and an actuating system on the base and changeable from a first state into a second state to thereby change the latch system from the latched state into the released state, the actuating system comprising at least a first link, having a substantially rigid fixed shape, which is movable axially within the passage from a first position into a second position to thereby change the latch system from the latched state into the released state, the actuating system further comprising an actuating assembly for the at least first link and comprising a second link that can be operatively connected to the at least first link without requiring separate fasteners, wherein the second link has a receptacle for supporting a part of the at least first link for pivoting movement about a second axis that is transverse to the first axis, wherein the at least first link has an elongate portion with a free end and the part of the at least first link is spaced from the free end, wherein the elongate portion has a substantially straight section extending along a first line substantially parallel to the first axis and the part of the at least first link extends transversely to the first line along a second line.

55. The operating mechanism for a movable closure element according to claim 54 wherein the at least first link has a free end section which projects a) along a third line that is transverse to the second line and b) to the free end of the elongate portion.

56. The operating mechanism for a movable closure element according to claim 55 wherein the first and third lines are substantially parallel to each other.

57. The operating mechanism for a movable closure element according to claim 55 wherein the elongate portion of the at least first link is connected to the second link by directing the elongate portion of the at least first link through the receptacle by relatively reorienting the at least first link and second link, while relatively moving the elongate portion of the at least first link and second link along the first and second lines as the elongate portion of the at least first link is directed through the receptacle.

58. The operating mechanism for a movable closure element according to claim 54 wherein a spring element acts between the actuating element and second link to urge the actuating element in pivoting movement relative to the base.

* * * * *